US010753128B2

(12) United States Patent
Presutti

(10) Patent No.: US 10,753,128 B2
(45) **Date of Patent: *Aug. 25, 2020**

(54) ACTIVATORS AND METHODS OF USING THE SAME FOR BARRICADING A DOOR

(71) Applicant: Michael Presutti, Chester, NJ (US)

(72) Inventor: Michael Presutti, Chester, NJ (US)

( * ) Notice: Subject to any disclaimer, the term of this patent is extended or adjusted under 35 U.S.C. 154(b) by 9 days.

This patent is subject to a terminal disclaimer.

(21) Appl. No.: 16/188,124

(22) Filed: Nov. 12, 2018

(65) Prior Publication Data

US 2019/0078362 A1 Mar. 14, 2019

Related U.S. Application Data

(63) Continuation-in-part of application No. 15/589,086, filed on May 8, 2017, now Pat. No. 10,125,525, which is a continuation-in-part of application No. 14/765,330, filed as application No. PCT/US2014/014340 on Feb. 1, 2014, now Pat. No. 9,644,408.

(60) Provisional application No. 61/759,951, filed on Feb. 1, 2013.

(51) Int. Cl.

| | |
|---|---|
| ***E01F 13/00*** | (2006.01) |
| ***E05C 19/00*** | (2006.01) |
| ***E05B 47/00*** | (2006.01) |
| ***G07C 9/00*** | (2020.01) |
| ***G07C 9/23*** | (2020.01) |

(52) U.S. Cl.

CPC ..... *E05C 19/005* (2013.01); *E05B 47/0001* (2013.01); *G07C 9/00174* (2013.01); *G07C 9/23* (2020.01); *E05Y 2900/132* (2013.01); *G07C 9/00722* (2013.01)

(58) Field of Classification Search

CPC ..... E05C 19/005; E06B 5/10; E05B 47/0001; E05B 45/06; E05B 2045/0695; E05B 2047/0086; A62C 13/78

USPC ..... 292/201, 288, 289, 297, 338, DIG. 12, 292/DIG. 15, DIG. 25

See application file for complete search history.

(56) References Cited

U.S. PATENT DOCUMENTS 9,644,408 B2 * 5/2017 Presutti ..... E05B 47/0012
10,125,525 B2 * 11/2018 Presutti ..... E05B 47/0012

* cited by examiner

*Primary Examiner* — Jerry E Redman
(74) *Attorney, Agent, or Firm* — Hodgson Russ LLP

(57) ABSTRACT

Barricade devices and methods of barricading a door are disclosed. Such devices and methods may be used to barricade a door, and thereby prevent an intruder from entering a sheltering space, such as a classroom, storeroom, or hallway. The barricade-device may have a pivotable stop-device that is pivotable from a location adjacent to a door. The pivot-location may be at an elevation that is lower than a door handle. The stop-device may be pivotable from a reserve-position to a stop-position. In the reserve-position, the stop-device does not barricade the door. In the barricade-position, the stop-device barricades the door. Operation of the barricade-device may require the application of an activation operation to an activator. A wide range of people having differing physical and mental capabilities may use the barricade-device properly and quickly.

40 Claims, 30 Drawing Sheets

ACTIVATORS AND METHODS OF USING THE SAME FOR BARRICADING A DOOR

CROSS REFERENCE TO RELATED APPLICATIONS

This application is a continuation-in-part of U.S. patent application Ser. No. 15/589,086 (filed on May 8, 2017), which issued as U.S. Pat. No. 10,125,525, which is a continuation-in-part of U.S. patent application Ser. No. 14/765,330 (filed on Aug. 1, 2015), which issued as U.S. Pat. No. 9,644,408. U.S. patent application Ser. No. 14/765,330 is a national phase application of PCT/US2014/014340 (filed Feb. 1, 2014). PCT/US2014/014340 claims the benefit of priority to U.S. provisional patent application Ser. No. 61/759,951 (filed on Feb. 1, 2013). As such, this continuation-in-part application claims the benefit of priority to Ser. Nos. 15/589,086, 14/765,330, PCT/052014/014340, and 61/759,951.

FIELD OF THE DISCLOSURE

The present invention relates to devices and methods of inhibiting the opening of a door. Such devices and methods may be used to barricade a door, and thereby prevent an intruder from entering a sheltering space, such as a classroom, storeroom, or hallway.

BACKGROUND OF THE DISCLOSURE

In the prior art, there are devices for barricading a door. U.S. Pat. No. 6,481,252 (Calle et al.) discloses one such device. In Calle et al.'s patent, a cross bar pivots from a hinge assembly that is mounted to a door frame. To barricade the door, the cross bar pivots down to engage a locking brace that is attached to another part of the door frame.

Another prior art device is described in German Pat. No. DE202006008723U1 (Hogl). In Hogl's device, a locking rod ("sperrstange 14") must be manually (a) lifted from the floor using a knob ("knauf 15"), (b) the rod must be rotated until the rod is aligned with a bracket, and (c) axially moved until the rod engages with the locking member ("sperrglied 6"). Successfully accomplishing these operations with one hand would be difficult, and for some people would be impossible—so, two hands are likely necessary to lift, rotate, and axially move the rod in order to achieve barricading of the door. Furthermore, Hogl's device requires the user to stand while barricading the door.

These devices and others in the prior art are difficult to use, especially for children, a person in a wheelchair, or a person that is crouching or lying on the floor. In a situation in which an intruder has entered a building, the prior art devices would likely prove inadequate because operating them is complicated and may be unsafe, thereby increasing the likelihood that a door will not be barricaded in time to prevent an intruder from entering the room.

SUMMARY OF THE DISCLOSURE

Door barricades and methods of barricading a door are disclosed herein. For example, a door barricade may have a pivotable stop-device, which has a barricade arm. The barricade arm may include a metal bar and/or a plastic extension. The barricade arm may be pivotable about a pivot axis. The pivot axis may be:

(a) nearer to an edge of the door where a latching mechanism of the door is located than to an edge of the door where door hinges are located, and (b) at an elevation lower than an elevation of a door handle on the door. For example, the pivot axis may be located adjacent to the door, for example to coincide with a frame of the door or a wall adjacent to the frame.

The barricade arm may be pivotable about the pivot axis from a reserve-position to a barricade-position. In the reserve-position, the barricade arm does not barricade the door and a distal-end of the barricade arm is at a first elevation. In the barricade-position, the barricade arm does barricade the door and the distal-end is at a second elevation. The elevations are measured from a floor adjacent to the door; the first elevation is less than the second elevation. When the stop-device and its barricade arm are in the barricade-position, the barricade arm does not span the width of the door.

The door barricade may include a bracket that is positioned to overlap the barricade arm when the barricade arm is in the barricade-position, but not when the barricade arm is in the reserve-position. The bracket may be oriented to receive and overlap the barricade arm as the barricade arm moves away from a floor adjacent to the door. In this manner, the barricade arm need only rotate in order to achieve the barricade-position and also be within the bracket once the barricade-position is achieved. The bracket may be mounted to a wall adjacent to the door, or to the door itself, or to a door frame that is associated with the door. Multiple brackets may be used and they may be mounted to one or more of a wall adjacent to the door, and/or to the door itself, and/or to a door frame that is associated with the door.

The barricade arm may have two ends. One end is located proximate to the pivot axis (the "proximate end") and the other end is located distally from the pivot axis (the "distal end"). In some embodiments of the invention, the distal end is not engaged with anything when the stop-device, and in particular the barricade arm, is in the barricade-position.

When some embodiments of the invention are in use, the distal-end of the barricade arm moves away from a floor adjacent to the door when the stop-device moves from the reserve-position toward the barricade-position. Such embodiments may be particularly well suited to be operated by a person who is lying on the floor, crouching next to the door, or sitting in a wheel chair.

Some embodiments of the invention are configured so that not more than three pounds of force applied to the distal-end of the barricade arm is required in order to move the stop-device, and in particular the barricade arm, to the barricade-position. A spring of motor may be employed for this purpose. For example, a person desiring to deploy the stop-device, and in particular the barricade arm, to the barricade-position may manually (e.g. by hand or by foot) apply a force not exceeding three pounds to the distal end of the barricade arm in order to move the distal end of the arm (and the stop-device) to a predetermined position, at which point the spring or motor may be activated to assist (partially or entirely) with moving the stop-device, and in particular the barricade arm, to the barricade-position. The motor may be powered by electricity. Such electricity may be provided by a battery, or by a power generating facility (e.g. a local electric utility company) having an electric generator.

When the door barricade includes a motor and/or spring for moving the stop-device, and in particular the barricade arm, the stop-device may include a linkage system so that forces supplied by the motor and/or spring are transferred in a manner that results in the barricade arm pivoting about the pivot axis. The linkage system may include a means for transferring force from the motor or spring to the barricade arm, such as one or more chains and/or gears.

Such a linkage system may selectively connect the motor and/or spring with the stop-device so that the barricade arm can be moved manually and without the assistance of the spring and/or motor. Toward that end, the linkage system may include a disengaging mechanism that disengages the motor and/or spring from the stop-device when the motor lacks the ability to move the barricade arm, and thereby permits moving the stop-device, and in particular the barricade arm, without moving the motor and/or spring.

Many embodiments of the invention may be configured so that not more than three pounds of force need to be applied to the distal-end of the barricade arm in order to move the barricade arm to a position in which the motor or spring will then move the barricade arm to the barricade-position.

As mentioned above, the stop-device and in particular the barricade arm, may be pivotable to rotate about an axis. The axis may be oriented and positioned so that the stop-device, and in particular the barricade arm, is positioned to rotate about an axis, which, if extended, would traverse a wall adjacent to the door. For example, the axis may be oriented to be substantially perpendicular to a wall adjacent to the door.

Some embodiments of the invention may include a fire extinguisher. To facilitate the inclusion of a fire extinguisher, the door barricade may have a means for holding the fire extinguisher. That means for holding may be a ledge on which the fire extinguisher is supported. Such a ledge may be part of a cover that conceals from view all or part of the stop-device.

The door barricade may include an alarm or may be connected to an alarm system that is triggered by a predetermined set of circumstances. The alarm or alarm system may include an audible notification and/or a visual notification in order to warn people of a particular type of situation. For example, the alarm may be triggered when (a) the stop-device, and in particular the barricade arm, begins to move toward the barricade-position, and/or (b) when the stop-device, and in particular the barricade arm, reaches the barricade-position, and/or (c) when a fire extinguisher is removed from the door barricade. In the case of an alarm that is triggered by the removal of the fire extinguisher, a switch may be provided for detecting the presence of the fire extinguisher. When the presence of the fire extinguisher is not detected, an alarm may be sounded and/or the fire department may be summoned.

A release/override mechanism may be provided so that the stop-device, and in particular the barricade arm, can be moved from the barricade-position to the reserve-position. Such a release/override mechanism may be operable by an authorized person (e.g. fire-fighter, police officer, school administrator) who is prevented from opening the door when the stop-device, and in particular the barricade arm, is in the barricade-position. In some embodiments of the invention, the release/override mechanism merely allows the stop-device to be moved to the reserve-position, while other embodiments of the release/override mechanism actually move the stop-device (e.g. by a motor or spring), and in particular the barricade arm, to the reserve-position. The release/override mechanism enables an authorized person to move the stop-device to the reserve-position, and then open the door in order to enter the room that was previously barricaded.

The barricade-device may include a shield that prevents access to the barricade arm by an intruder when the stop-device is in the barricade-position. Such a shield may be mounted to the door that is being barricaded, and positioned between the barricade arm and a window on the door so that if the intruder breaks the window and reaches toward the barricade arm, the shield prevents the intruder from touching the barricade arm. Such a shield may be used to prevent the intruder from damaging the barricade arm, or moving the barricade arm as part of an attempt to gain access to the room associated with the door.

The barricade-device may include an activator, which, when utilized, may result in activation of a barricade system (such as the barricade system described herein) that prevents or inhibits opening of the door. In that situation, use of the activator may result in a barricade arm pivoting from a reserve-position to a barricade-position. Such an activator may be located in various locations on or near the barricade-device. In any embodiments of the invention having an activator, an activation operation involves the application of a force of three pounds or less to the activator. An activation operation is the utilization of the activator to send a signal from the activator such that the barricade system prevents or inhibits opening of the door. For example, the activation operation may send a signal that results in the barricade arm being pivoted about the pivot axis.

Embodiments of the door barricade provide a pivotable stop-device including a barricade arm that is pivotable about an axis from a reserve-position to a barricade-position. In the reserve-position, the barricade arm does not barricade the door and a free-end of the barricade arm is at a first elevation. In the barricade-position the barricade arm does barricade the door and the free-end is at a second elevation. The axis may be nearer to an edge of a door where a latching mechanism of the door is located than to an edge of the door where door hinges are located, and at an elevation lower than an elevation of a door handle. The elevations may be measured from a floor adjacent to the door. The first elevation may be less than the second elevation. When the stop-device is in the barricade position, the barricade arm need not span the width of the door. The activator, when utilized, can result in the barricade arm pivoting about the axis.

In an embodiment of the invention, the door barricade further comprises a motor capable of providing a force to move the stop-device to the barricade-position, wherein the motor is operatively connected to the activator, and the activator is configured to result in operation of the motor when utilized.

The activator may include a button, which may be selected from the group consisting of substantially rectangular, substantially circular, and substantially triangular. The barricade-device may be configured to move the barricade arm to the barricade-position after the button is pressed.

The activator may include a first button which, when pressed, may raise the barricade arm and a second button which, when pressed, may lower the barricade arm. The first button may be substantially triangular pointing in the upwards direction and the second button may be substantially triangular pointing in the downwards direction.

The activator may include a toggle switch or a throw lever.

The activator may include an authenticator configured to allow only an authorized individual to utilize the activator. The authenticator may include a keypad that is configured to receive a code entered by the individual, a fingerprint scanner capable of scanning a fingerprint of an individual, a card scanner configured to scan a card of the individual, or at least two buttons configured to be pressed substantially simultaneously by the individual. The two buttons may be disposed such that a longest distance between them is twelve inches or less. The two buttons may be disposed such that a longest distance between them is greater than twelve inches and less than or equal to thirty-six inches.

The activator may be disposed on the housing of the barricade-device, on a wall adjacent to the door on a wall near the door, behind the door when the door is open, or on the door. The activator may be disposed at an elevation that is equal to or less than an elevation of the door handle.

A fingerprint scanner may be provided which is capable of scanning a fingerprint, converting the fingerprint to fingerprint data, and storing the fingerprint data.

Embodiments of the present invention may include a method of barricading a door, comprising providing a pivotable barricade arm having a pivot-axis at a fixed location on the barricade arm and providing an activator, which when utilized results in pivoting of the barricade arm from the reserve-position to the barricade-position, or pivoting of the barricade arm from the barricade-position to the reserve-position. Utilization of the activator may be effected by a user executing an activation operation on the activator, the activation operation requiring the user to apply not more than three pounds of force. The method may further include, with the door in a closed position, executing the activation operation on the activator to cause the barricade arm to pivot about the pivot-axis from the reserve-position (where the barricade arm does not barricade the door, and a free-end of the barricade arm is at a first elevation measured above a floor adjacent to the door) to the barricade-position (where the barricade arm barricades the door, and the free-end is at a second elevation measured above the floor adjacent to the door). The elevations may be measured from the floor adjacent to the door, and the first elevation is less than the second elevation. When the barricade arm is in the barricade-position, the barricade arm need not span a width of the door and the barricade-position may be achieved solely by the barricade arm pivoting from the reserve-position.

The pivot axis may be at a location that is nearer to an edge of the door where a latching mechanism of the door is located than to an edge of the door where door hinges are located and at an elevation lower than an elevation of a door handle.

Embodiments of a method according to the invention may further comprise providing a motor capable of providing a pivot force to pivot the barricade arm without user-assistance to the barricade-position, wherein the motor is operatively connected to the activator, and pivoting the barricade arm using the motor.

An activator according to the present invention may comprise a button, and the button may have a shape that is selected from the group consisting of substantially rectangular, substantially circular, and substantially triangular. The method may include, when the barricade arm is in the reserve-position, pressing the button.

An activator may include a first button and a second button. The activation operation may include pressing the first button, which results in the barricade arm moving from the reserve-position to the barricade-position. Pressing the second button may result in the barricade arm moving from the barricade-position to the reserve-position.

The first button may be substantially triangular pointing in an upwards direction and the second button may be substantially triangular pointing in a downwards direction.

The activator may include a toggle switch or a throw lever, and the activation operation may include applying the not more than three pounds of force to the toggle switch or throw lever.

The activator may include an authenticator configured to allow only an authorized individual to complete the activation operation. The authenticator may include a keypad, wherein the activation operation includes entering a code using the keypad. The authenticator may include a fingerprint scanner, and the activation operation may include scanning a fingerprint using the fingerprint scanner. The authenticator may include a card scanner, and the activation operation may include scanning a card using the card scanner. The authenticator may include at least two buttons, and the activation operation may include pressing the at least two buttons substantially simultaneously. The two buttons may be disposed such that a distance between them is twelve inches or less. Or, the at least two buttons may be disposed such that a distance between them is greater than twelve inches and less than or equal to thirty-six inches.

The activator may include a fingerprint scanner, and the method may further comprise scanning a fingerprint, converting the fingerprint to fingerprint data, and storing the fingerprint data.

BRIEF DESCRIPTION OF THE FIGURES

For a fuller understanding of the nature and objects of the invention, reference should be made to the accompanying drawings and the subsequent description. Briefly, the drawings are.

DETAILED DESCRIPTION OF THE DISCLOSURE

Figure 1:
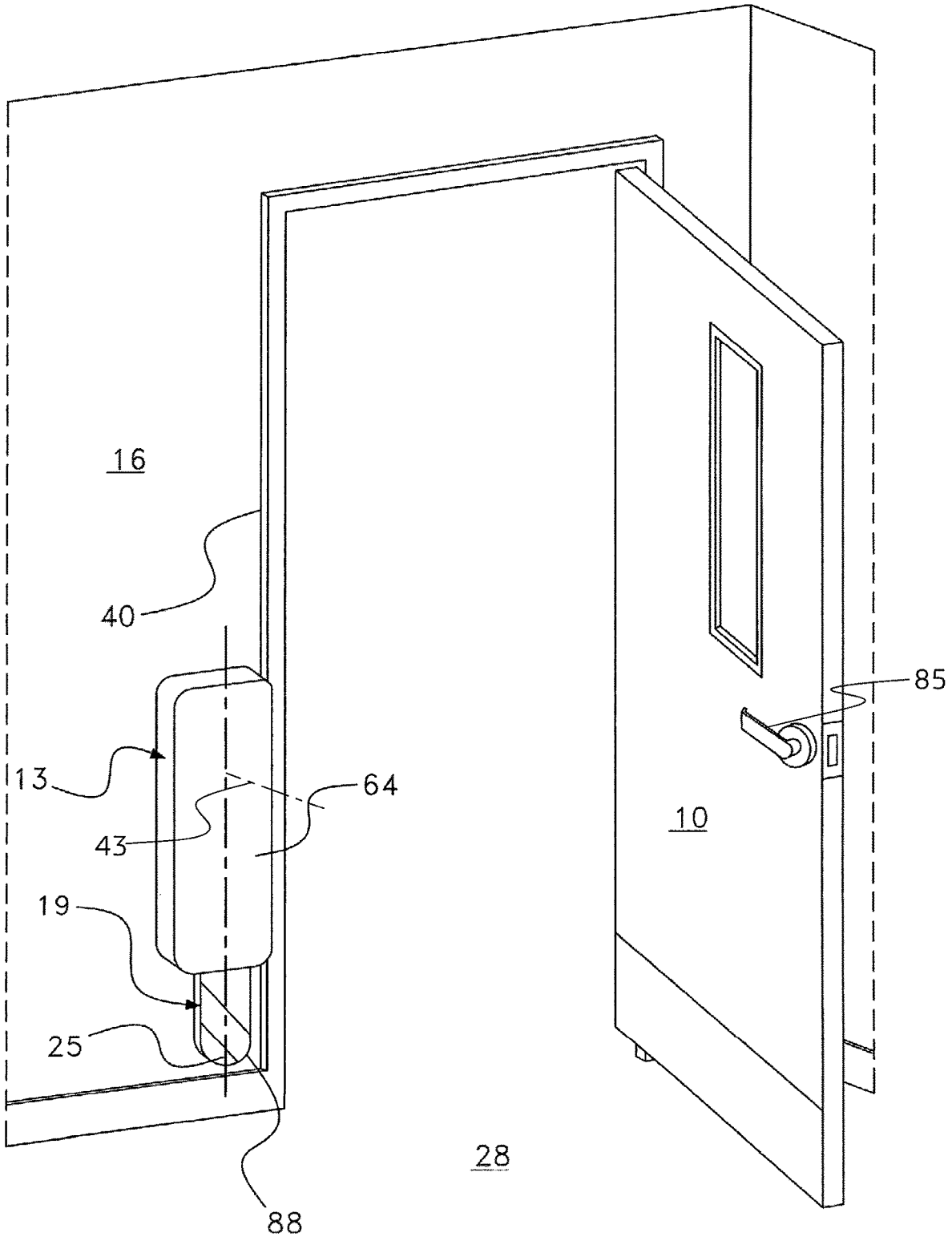
FIG. 1 depicts a classroom having a barricade-device mounted to a wall adjacent to a door.

Disclosed herein are barricade-devices that may be used to barricade a door, and thereby prevent an intruder from entering a safe sheltering space, such as a classroom or hallway. Initially, a general description of features that may be included in a door barricade is provided. Then, with reference to the figures, a more detailed description of some specific embodiments of the invention is provided.

The barricade-device may have a pivotable stop-device that is pivotable from a location adjacent to a door. The pivot-location is at an elevation that is lower than a door handle on the door. The stop-device is pivotable from a reserve-position to a barricade-position. In the reserve-position, the stop-device does not barricade the door. In the barricade-position, the stop-device barricades the door.

The barricade-device may include a bracket that is positioned to overlap an arm of the stop-device when the stop-device is in the barricade-position. But when the stop-device is in the reserve-position, the bracket does not overlap the stop-device. The bracket may be oriented to receive the stop-device as the stop-device moves away from a floor adjacent to the door and into the barricade-position.

The barricade-device may include one or more brackets for overlapping the arm when the stop-device is in the barricade-position. Such brackets may be mounted to the door, but other locations are possible. For example, brackets may be mounted to the door frame that is located between the door and the axis about which the stop-device rotates, and/or to the wall between the door frame and the axis about which the stop-device rotates.

Also disclosed herein is a method of barricading a door. Such a method may include providing a pivotable stop-device that is positioned to pivot from a pivot-location. The pivot-location may be adjacent to the door at an elevation that is lower than a door handle, which is on the door and used to unlatch the door. Such a method includes pivoting the stop-device about the pivot-location from the reserve-position to the barricade-position. The method may include providing a bracket that is positioned to overlap an arm of the stop-device when the stop-device is in the barricade-position, but not when the stop-device is in the reserve-position. In such a method, the step of pivoting the stop-device may include the bracket receiving the stop-device as the stop-device moves away from a floor adjacent to the door and into the barricade-position.

In a specific embodiment of the invention, a barricade-device for a door is arranged to prevent intruders from entering a room. That barricade-device may have a movable stop-device and a spring that is mechanically linked to the stop-device so as to bias the stop-device to a barricade-position, in which an arm of the stop-device prevents a door from opening. The stop-device may include a pivotable cam and an arm extending from the cam. A distal-end of the arm moves away from a floor adjacent to the door when the stop-device moves toward the barricade-position. In one embodiment of the barricade-device, not more than three pounds of force (applied to the distal-end of the arm) is required to move the stop-device to a position in which the spring will then move the stop-device to the barricade-position. Such a force may be applied by hand or by foot.

To assist with moving the stop-device, a motor may be employed to provide a force that moves the stop-device to the barricade-position, or to a reserve-position, or both. The motor may be included along with the spring, or in lieu of the spring mentioned above. A linkage system may selectively connect the motor with the stop-device in order to transfer a force from the motor to the stop-device. A chain and/or gears (which may include sprockets) may be used in the linkage system. A disengaging mechanism may be included as part of the linkage system in order to disengage the motor from the stop-device when the motor lacks the ability to move the stop-device, and thereby permits moving the stop-device manually, for example, if electricity is not available to the motor due to an interruption of electric power.

When the motor is included, the motor may be activated by application of a force to the distal-end of the arm. Such a force may be applied by hand or by foot. When the force applied to the distal-end of the arm moves the stop-device by a predetermined amount, the motor turns on to bring the stop-device to the desired position (either the barricade-position or the reserve-position, depending on the direction in which the force is applied to the distal-end of the arm).

The barricade-device may be attached to a wall adjacent to the door at an elevation that places the cam lower than an elevation of a door-handle of the door. In doing so, the barricade-device may be made readily usable by many people, including children, those in wheel chairs, and those lying, crouching or kneeling on the floor.

A release/override mechanism may be provided that may be used to move the stop-device from the barricade-position to the reserve-position. It is anticipated that an authorized person who is otherwise prevented from opening the door when the stop-device is in the barricade-position may operate the release/override mechanism.

Having provided a general overview of features that may be included in a door barricade, a more detailed description of some embodiments is provided below.

Figure 2:
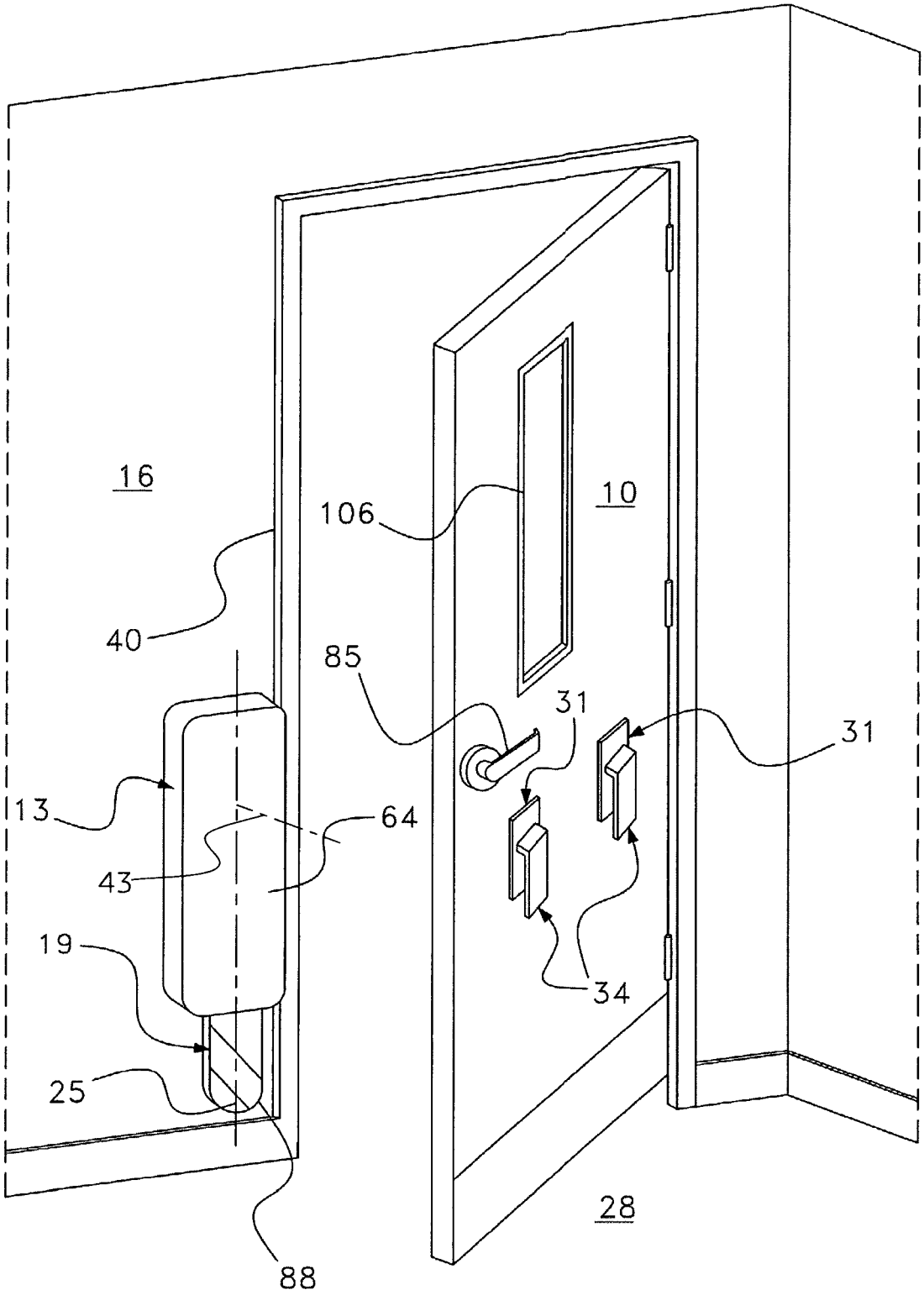
FIG. 2 depicts the classroom of FIG. 1 with the door partially closed.
Figure 3:
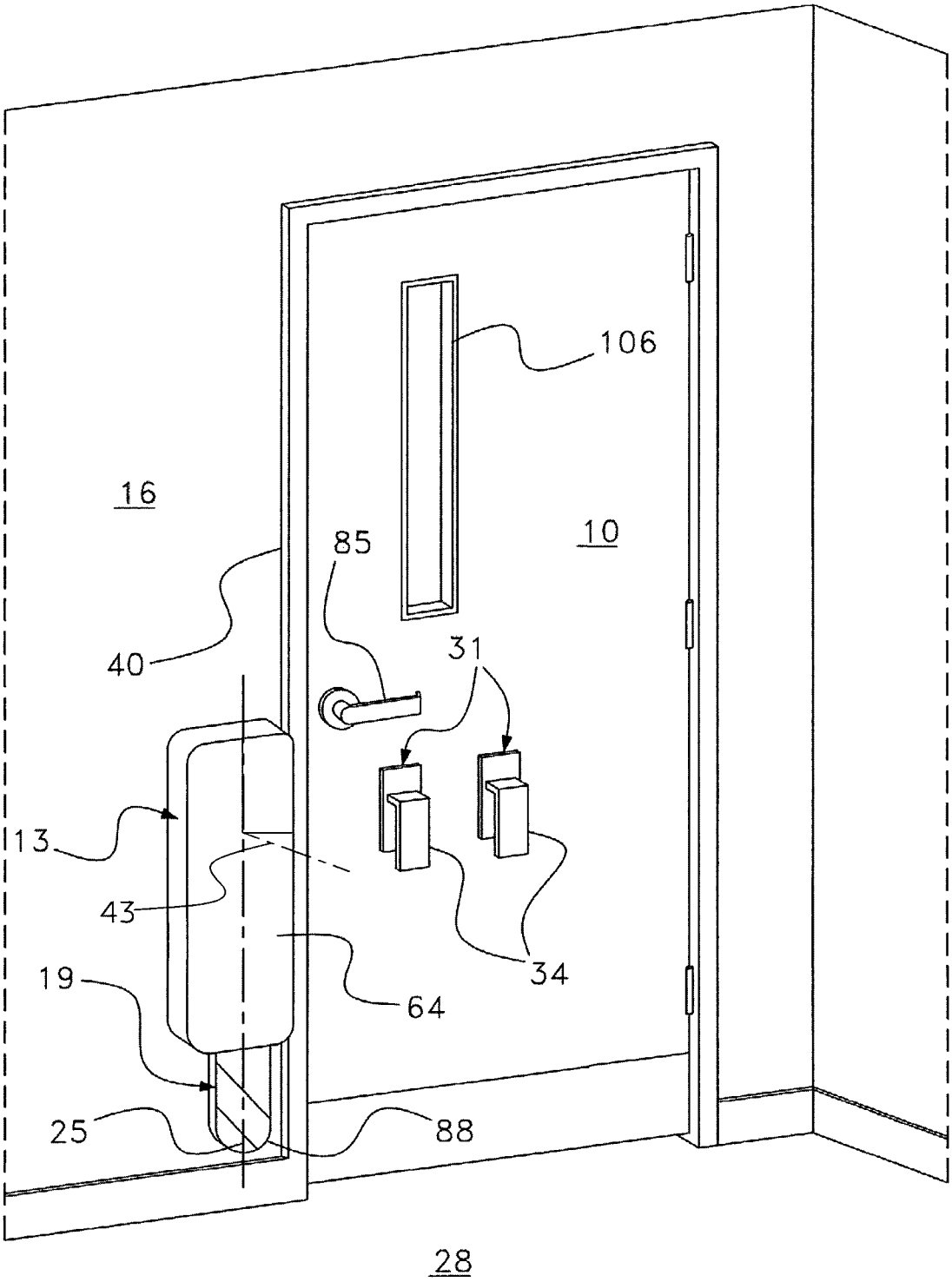
FIG. 3 depicts the classroom of FIG. 1 with the door closed.

FIGS. 1-5 depict a classroom door 10 and a barricade-device 13 at various stages. FIG. 1 shows the classroom door 10 open and the barricade-device 13 mounted to a wall 16 adjacent to the door 10. FIG. 2 shows the door 10 in a partially closed position, and FIG. 3 shows the door 10 in the closed position. In FIGS. 1-3, the barricade-device 13 does not prevent the door 10 from opening or closing, and thus these three figures illustrate how the barricade-device 13 might look when there is no need to prevent an intruder from entering the classroom. In this position, an arm 19 of the barricade-device 13 is held in reserve, and is therefore said to be in the "reserve-position." The arm 19 is part of a stop-device 22, which is explained more fully below in conjunction with FIGS. 8 and 10 (among others). In FIG. 1, the reserve-position is fully achieved when a longitudinal axis 25 of the arm 19 is substantially vertical relative to the floor 28 adjacent to the door 10. Herein, the floor 28 is assumed to be (for descriptive purposes) a substantially horizontal reference plane.

Figure 4:
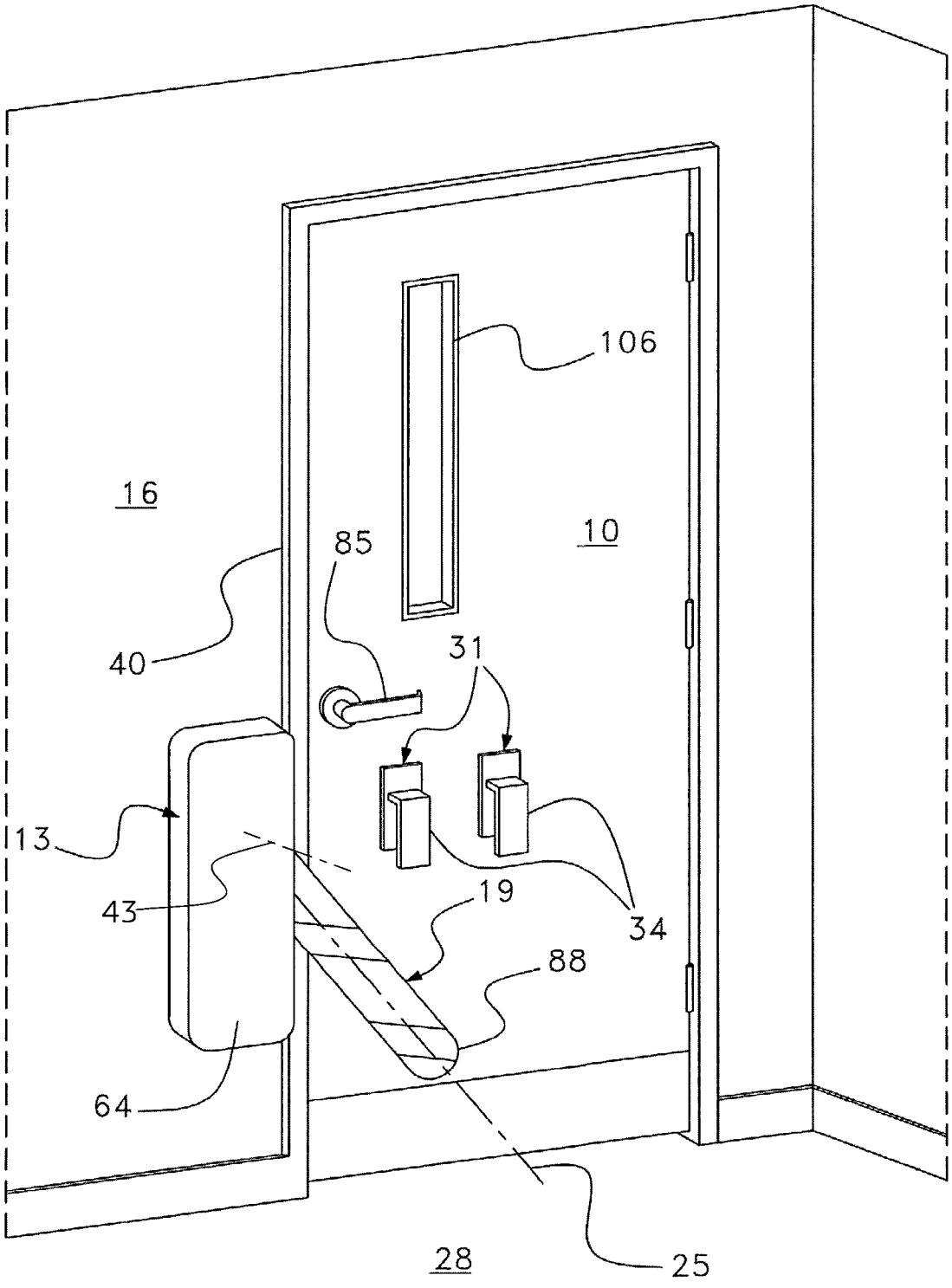
FIG. 4 depicts the classroom of FIG. 3 with an arm of the barricade-device partially deployed toward the barricade-position.
Figure 5:
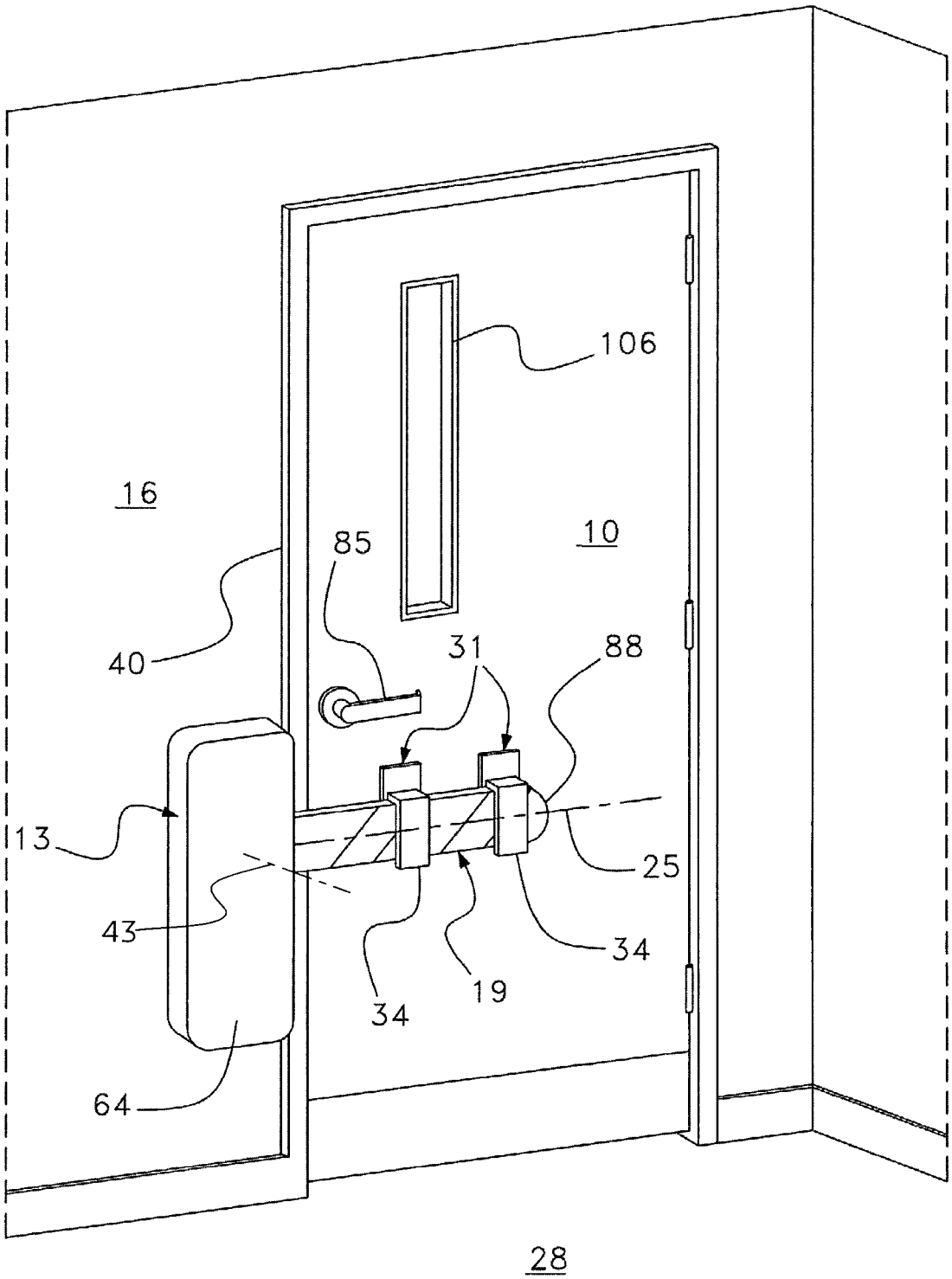
FIG. 5 depicts the class room of FIG. 3 with the arm of the barricade-device in the barricade-position.

FIG. 4 shows the arm that is moving from its reserve-position toward a barricade-position, which is shown in FIG. 5. In the barricade-position, the arm 19 inhibits or prevents the door 10 from being opened. In FIG. 5, the barricade-position is fully achieved when the longitudinal axis 25 of the arm 19 is substantially horizontal. That is to say that in FIG. 5, the barricade-position is fully achieved when the longitudinal axis 25 of the arm 19 is substantially parallel with the reference plane—here, the floor 28. It should be noted that in some embodiments of the barricade-device 13, the barricade-position may be achieved when the longitudinal axis 25 is not substantially parallel with the floor 28. Also, it should be noted that a distal-end 88 of the arm 19 moves away from the floor 28, which is adjacent to the door 10, when the stop-device 22 moves from the reserve-position toward the barricade-position.

FIGS. 4 and 5 show a pair of brackets 31 that have been mounted to the door 10. The brackets 31 are designed and mounted to overlap the arm 19 when the stop-device 22 is in the barricade-position, but not when the stop-device 22 is in the reserve-position. The brackets 31 overlap the arm 19 so that the arm 19 resides between an outer-portion 34 of the bracket 31 and the door 10 when the stop-device 22 is in the barricade-position. When the stop-device 22 is not in the barricade-position, for example when the stop-device 22 is in the reserve-position, the arm 19 is not overlapped by the brackets 31. Some embodiments of the barricade-device 13 include a bracket 31 that is not mounted to the door 10, and/or the frame 40, and/or the wall 16, and other embodiments do not have any brackets for overlapping the arm 19.

Unlike many prior art devices, the arrangement shown in FIG. 5 does not require the arm 19 to span the entire width of the door 10. By providing brackets (e.g. to the door 10) and providing a wall-anchored body assembly, the fulcrum points are shortened and the assembly strengthened, thereby making a door barricade that does not require a bar to span the entire width of the door 10. The stop-device 22 pivots from a location that is near an edge of the door 10 where the door handle 85 and associated latching mechanism is located, rather than being positioned closer to the hinged-edge of the door 10. Door handle 85 may be, for example, a handle, knob, lever, pull handle, push bar, or other latch interface. By making and locating the stop-device 22 in a manner that does not require the arm 19 to span the width of the door 10 in order to achieve barricading of the door 10, the barricade-device 13 can be mounted nearer the floor 28, and also the barricade-device 13 may be operated so that the arm 19 moves upward (away from the floor 28) from the reserve-position to the barricade-position. This mode of operation allows a shorter person such as a child, a wheel-chair-bound person or someone in a crouched or kneeling position to deploy the arm 19 to the barricade-position. In addition, by not requiring the arm 19 to span the width of the door 10, the arm 19 can be moved to the barricade-position faster than the prior art barricades.

The barricade-device 13 may be equipped with an alarm, which is activated when the stop-device 22 moves from the reserve-position toward the barricade-position and/or when the stop-device 22 achieves the barricade-position. The alarm may provide an audible notification, visual notification, or both. In this manner, it will be possible to know when and where doors have been barricaded. An audible alarm may be provided as a siren or buzzer. A visual alarm may be provided as a light, which may flash.

Figure 7:
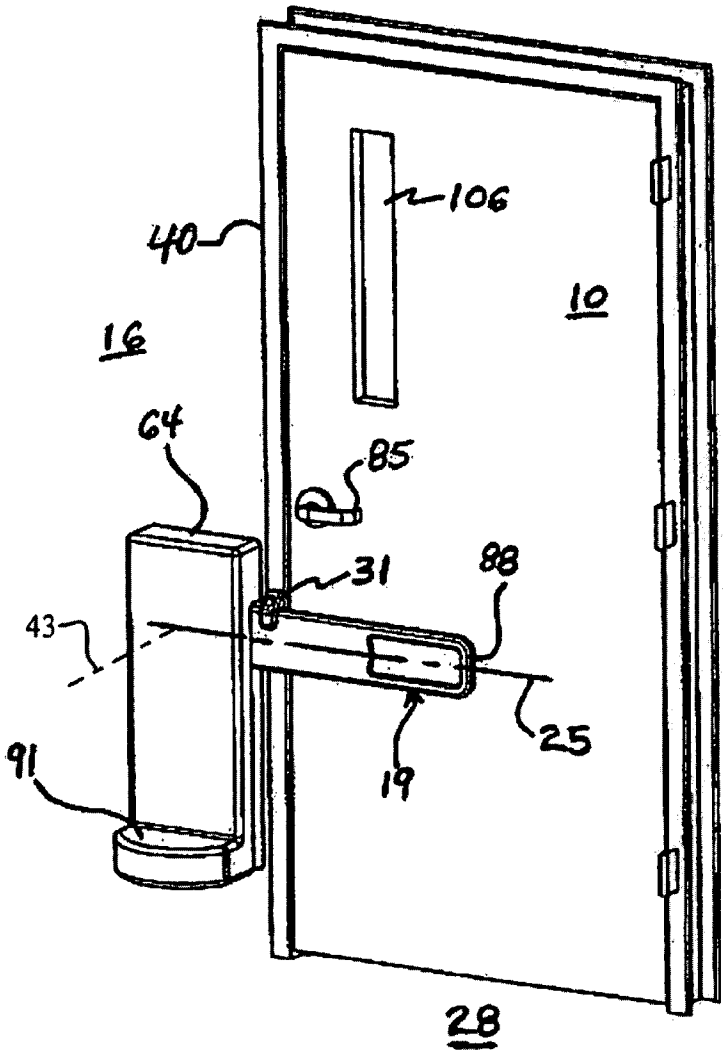
FIG. 7 depicts the arrangement of FIG. 6 with the arm in the barricade-position.
Figure 6:
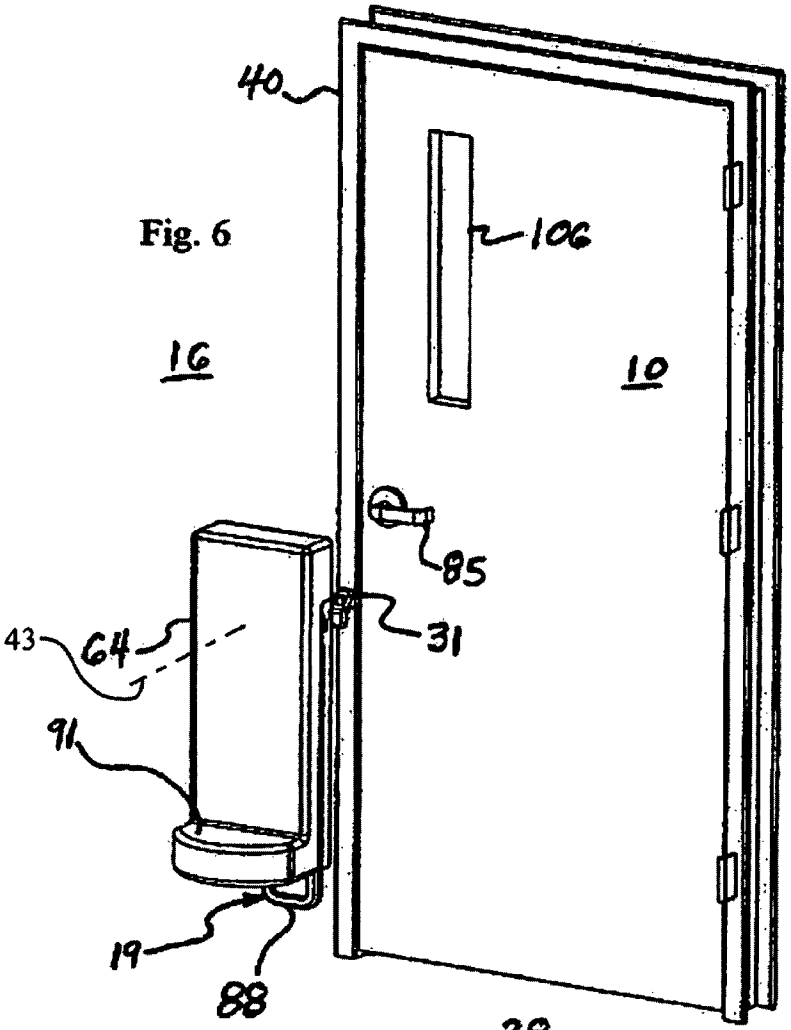
FIG. 6 depicts another arrangement of a barricade-device with the arm in a reserve-position.
Figure 17:
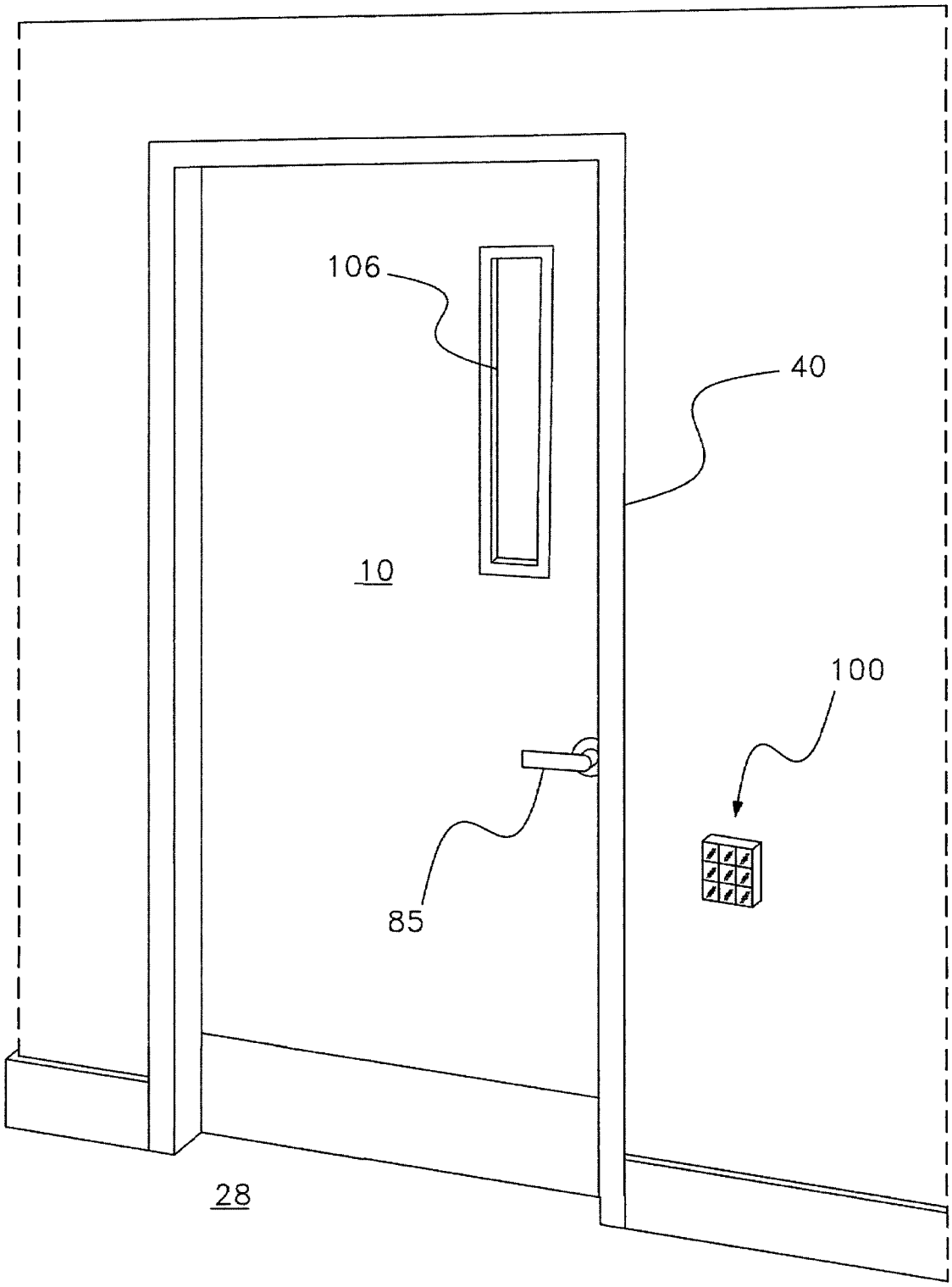
FIG. 17 depicts a side of a classroom door that is opposite to the side having the barricade-device.

FIGS. 6 and 7 show a different embodiment of the barricade-device 13 in which a bracket 31 is mounted at a location between a cam 37 (see FIGS. 8 and 10) and the door 10. In this particular arrangement, the bracket 31 is mounted to the door frame 40. In this arrangement, the bracket 31 is mounted at a location between the door 10 and an axis 43 about which the stop-device 22 rotates between the reserve-position and the barricade-position. Like the embodiment shown in FIGS. 1-5, the arm 19 does not extend across the entire width of the door 10. Also like the embodiment shown in FIGS. 1-5, the stop-device 22 pivots from a location that is near an edge of the door 10 where the door handle 85 and associated latching mechanism is located, rather than being positioned closer to the hinged-edge of the door 10. Another option affixes a bracket 31 to the wall 16 at a location that is between that stop-device axis 43 and the door frame 40. For clarity, FIG. 17 show a barricade-device 13 in which the stop-device 22 rotates about an axis 43, which (if extended) would traverse the wall 16 adjacent to the door 10. More specifically, FIGS. 1-7 show a barricade-device in which the stop-device 22 rotates about an axis 43 that is substantially perpendicular to the wall 16 that is adjacent to the door 10.

Figure 8:
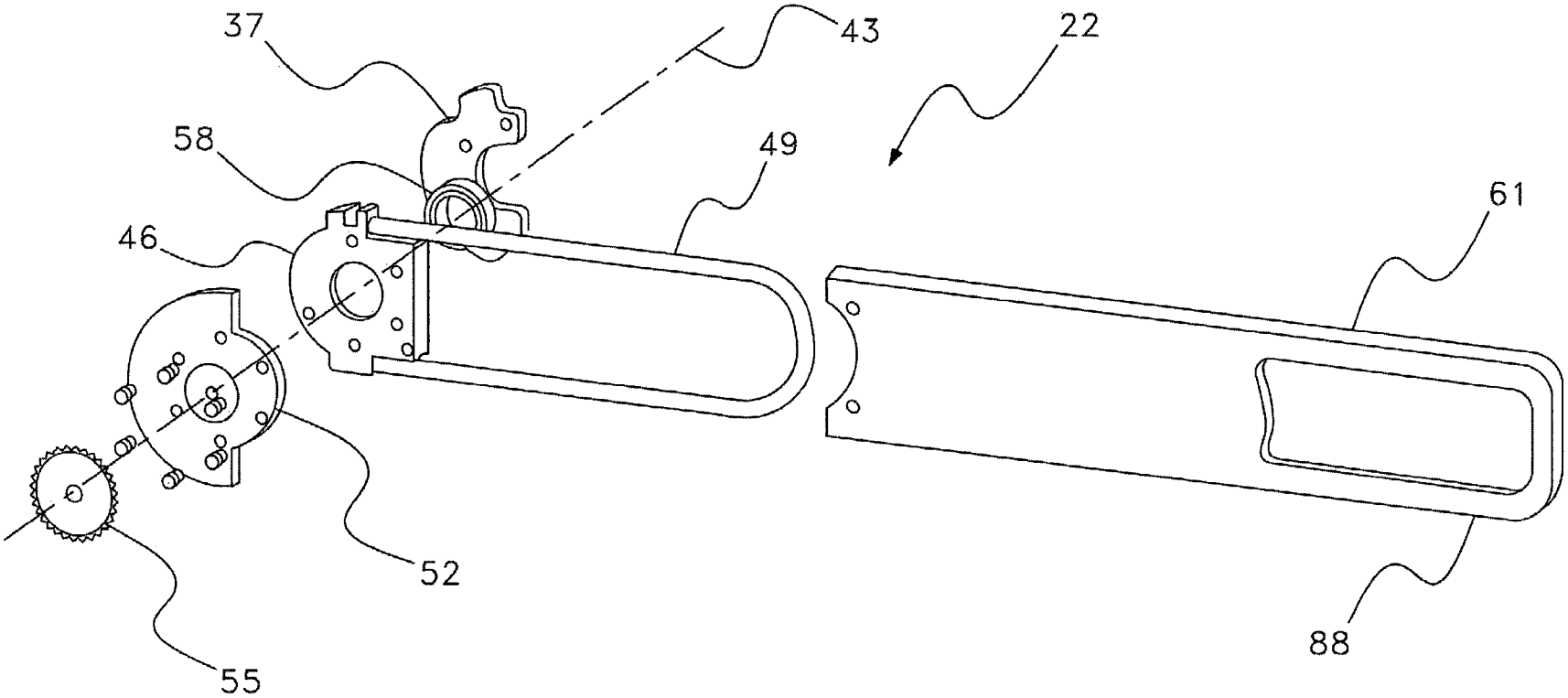
FIG. 8 depicts features of a stop-device.

FIG. 8 shows details of a stop-device 22 that may be used. That stop-device 22 includes a connective base 46, a bar 49 that is connected to the base 46, a motion control cam 37 that is connected to the base 46, a spring-anchor 52 that is connected to the base 46, a sprocket 55 that is connected to the anchor 52, and a bearing 58. The bar 49 may be covered by a plastic extension 61 in order to make the stop-device 22 more aesthetically pleasing, and in order to extend the distal-end of the stop-device 22 so that less force is required. (by virtue of the longer moment arm) to manually move the stop-device 22 between the reserve-position and the barricade-position. In the arrangement depicted in FIG. 8, the bar 49 and extension 61 comprise what was previously referred to as the arm 19.

Figure 9:
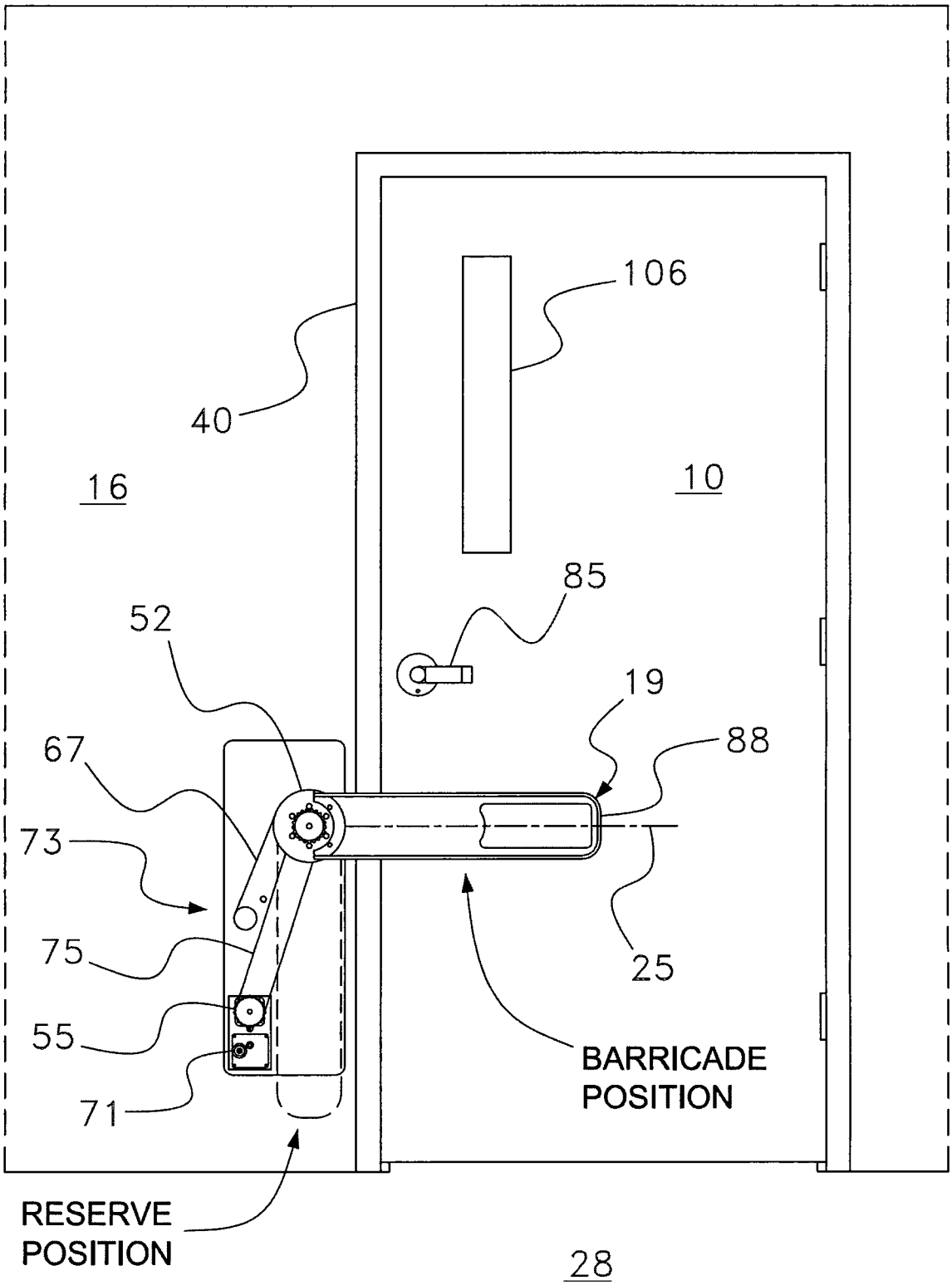
FIG. 9 depicts the arrangement of FIG. 7 with a protective cover removed to show certain features of the barricade-device.

FIG. 9 shows yet another embodiment of the barricade-device 13, in which there is no bracket. Although the barricade-device 13 may be configured without a bracket, it is currently believed that having one or more brackets 31 may make the barricade-device 13 better able to prevent opening of the door 10 by an intruder.

Figure 10:
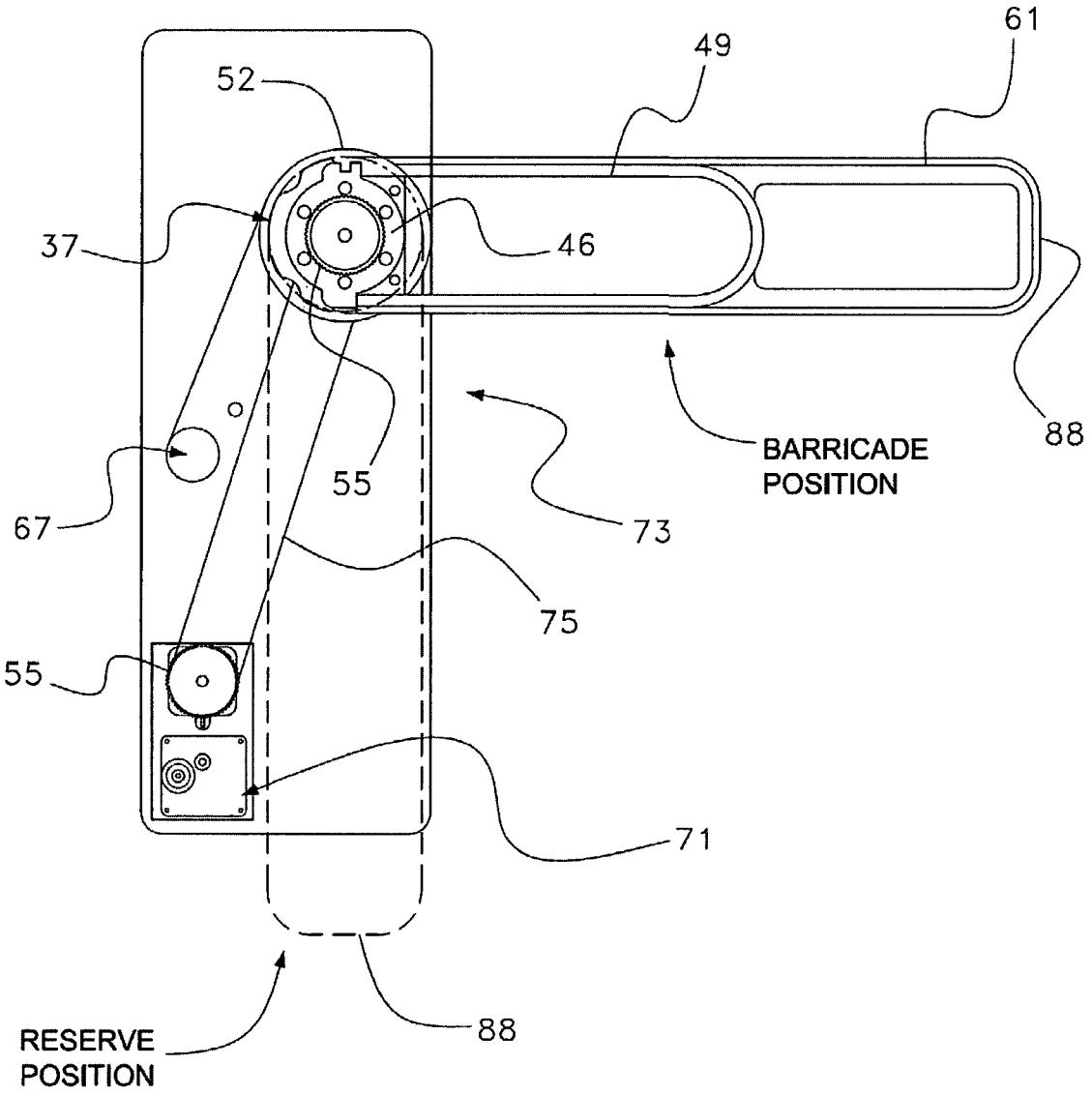
FIG. 10 is an enlarged view of the barricade-device depicted in FIG. 9, with the plastic extension shown in phantom to reveal aspects of the movable stop-device.
Figure 11:
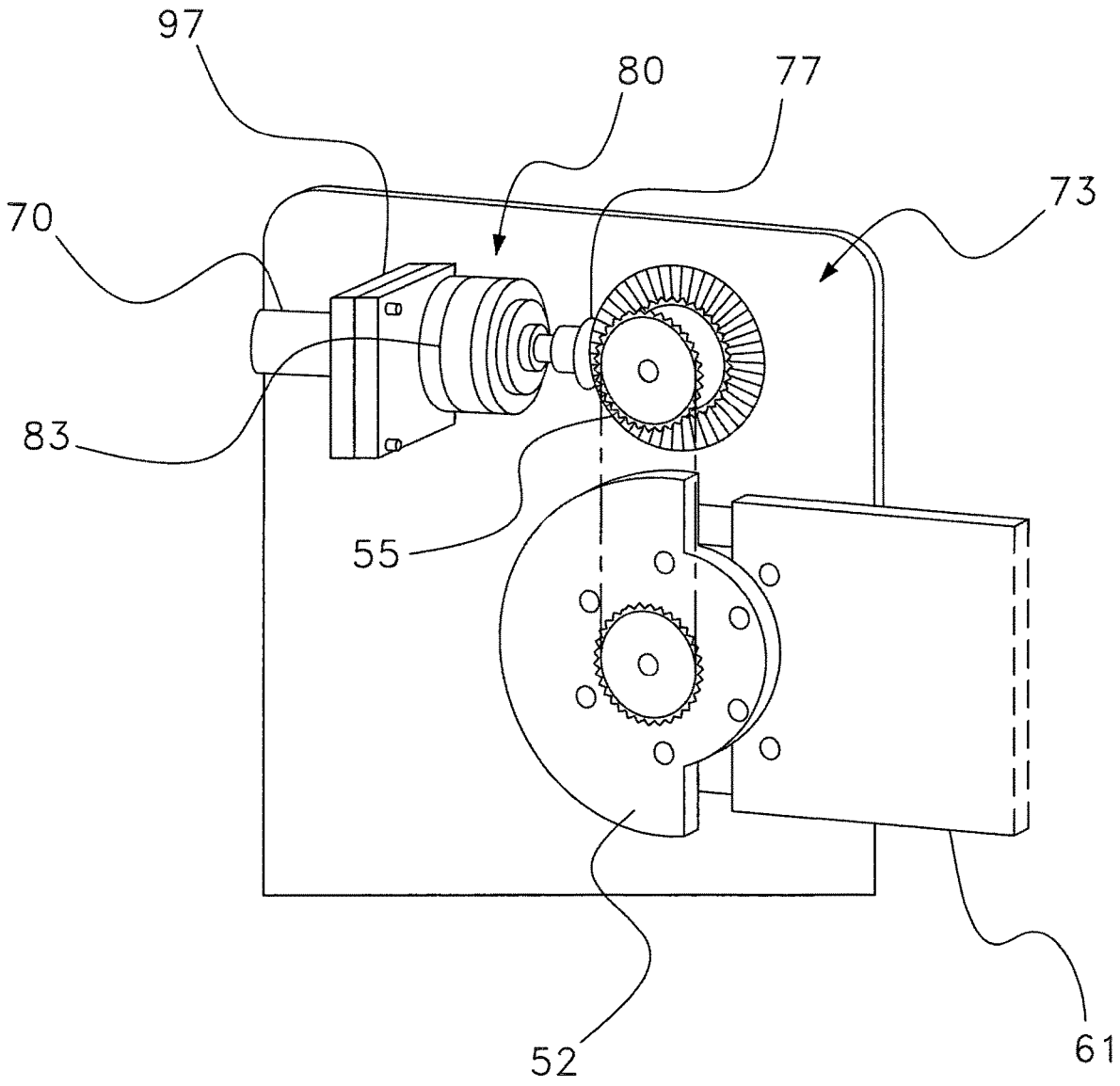
FIGS. 11 and 12 depict an arrangement of the barricade-device having a motor and linkage system.
Figure 12:
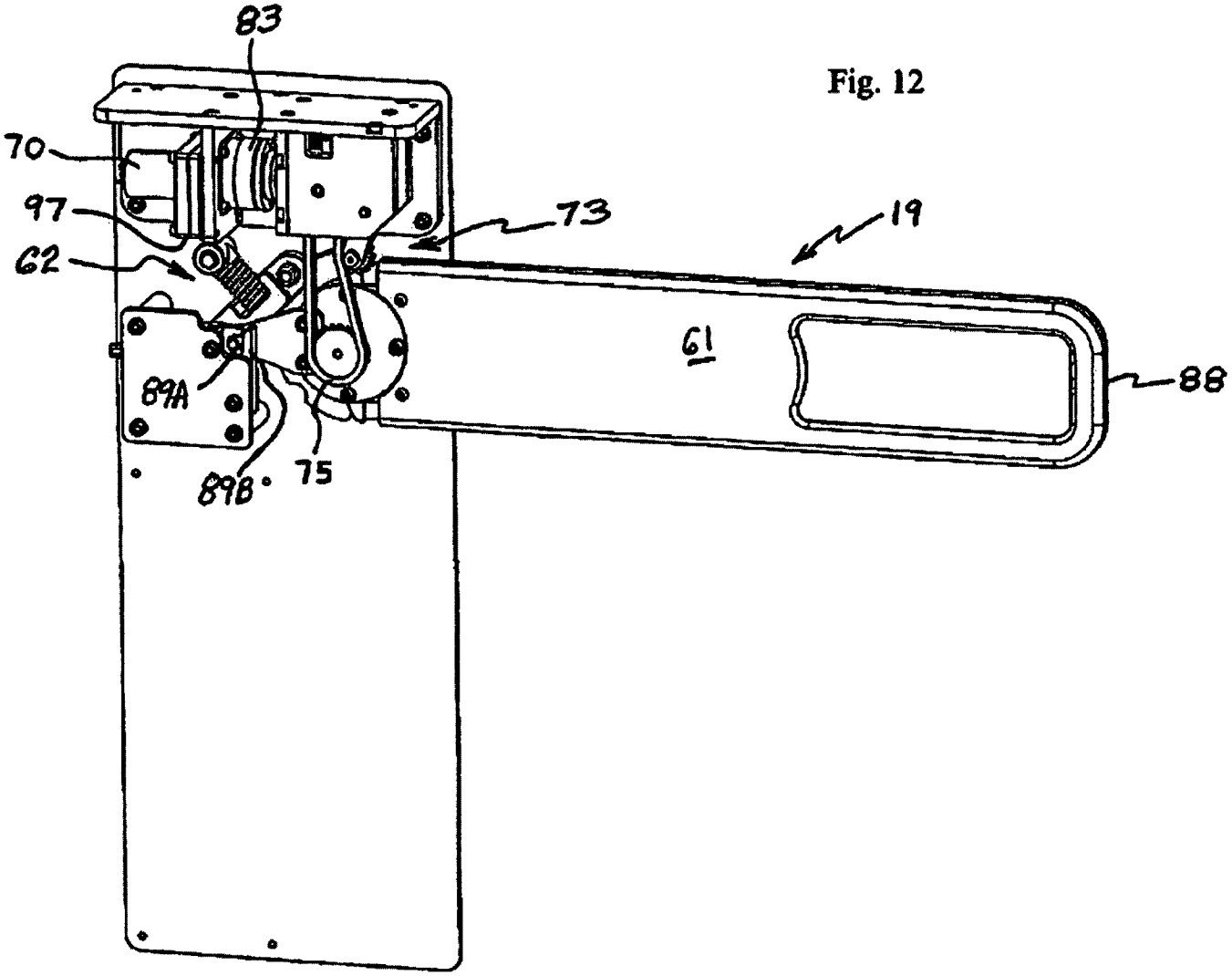
Figure 13:
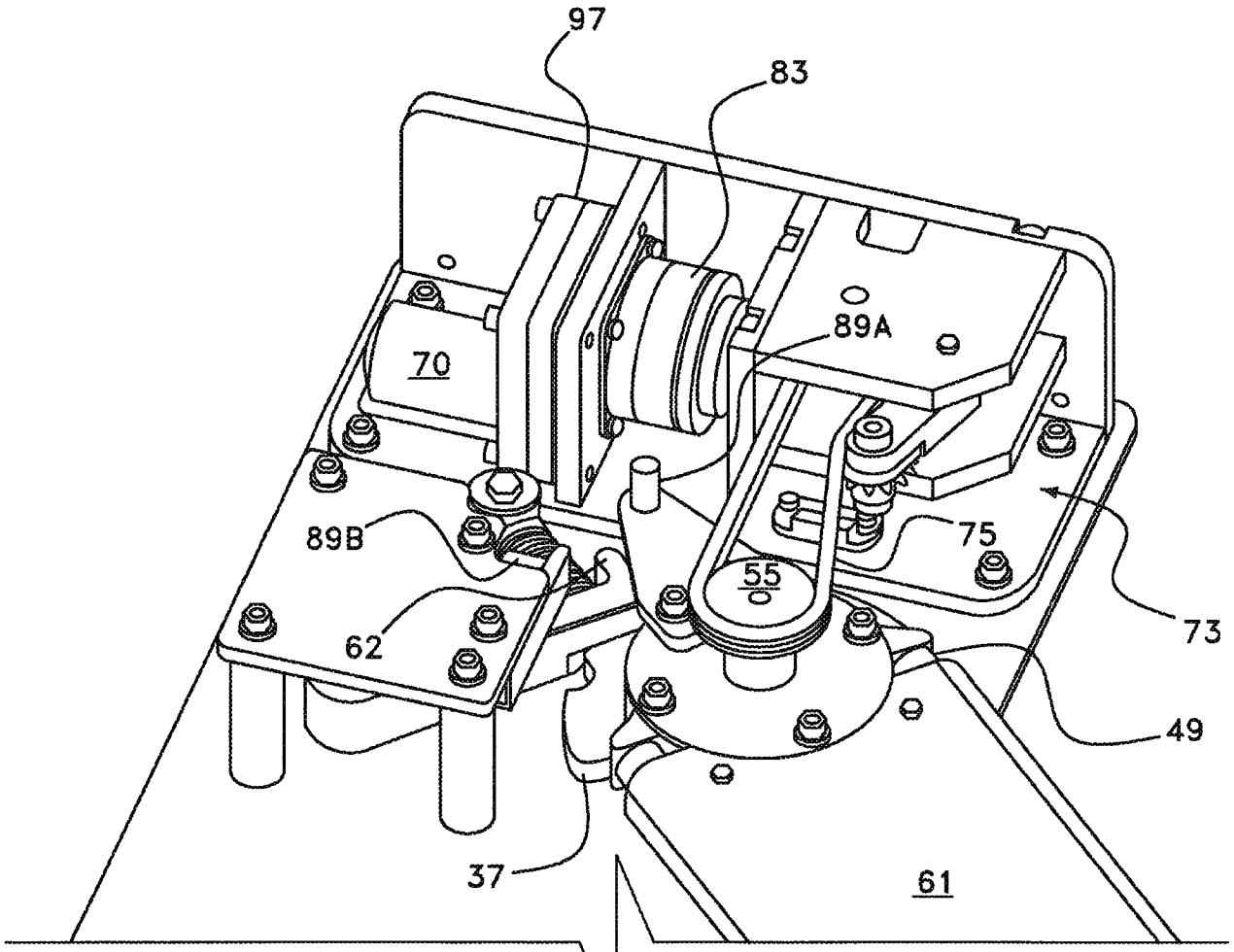
FIG. 13 depicts another arrangement having a motor and linkage system.

Unlike FIGS. 1-7, FIGS. 1 and 10 depict the barricade-device 13 without the protective cover 64 so that additional details may be more easily described. FIG. 10 is an enlarged view of the barricade-device 13 that is depicted in FIG. 9. FIGS. 9 and 10, illustrate that the stop-device 22 may be comprised of an arm 19 that is attached to a cam 37. Although the cam 37 and the bar 49 are depicted as two pieces, the arm 19 and the cam 37 may be provided as a unitary piece.

The barricade-device 13 may include a spring 67, which is mechanically linked to the stop-device 22. For example, the spring 67 may be mechanically linked to the anchor 52. The spring 67 biases the stop-device 22 to the barricade-position (see, for example, FIGS. 5, 7 and 9), in which the arm 19 prevents a door 10 from opening. The cam 37 is part of a motion control system that includes a cam follower 62. The shape of the cam 37 may be made so that the force of the spring 67 is not enough to move the stop-device 22 to the barricade-position until the stop-device 22 is rotated a desired amount (e.g. 5 degrees of rotation about the axis 43). Upon being rotated the desired amount (e.g. by a force applied by hand or by foot to the distal-end 88 of the arm 19), a resistance-force provided by the cam follower 62 will be reduced by virtue of the shape of the cam 37, and with the resistance-force reduced, the force provided by the spring 67 is sufficient to move the stop-device 22 to the barricade-position. It should be noted that, unlike many prior art devices, the force required to rotate the stop-device 22 about the axis 43 allows the use of major muscle groups of the body, and need not require precise dexterity of the fingers or hands (e.g. such as that required to manipulate small keys, latches, and/or the grasping and turning of assemblies). As such, with the prior art barricades in mind, it will be recognized that the barricade-device 13 may be used effectively for its designed purpose more quickly by a wider range of people having differing physical and mental capabilities.

Also shown in FIGS. 9 and 10 is a motor 70 that is capable of providing a force to move the stop-device 22. For example, the motor 70 may be powered by electricity, which may be provided by an electric utility via wires from the power-supply grid to the building, or by a battery 71, which may be concealed from view by the protective cover 64. The motor 70 may be configured to move the stop-device 22 from the reserve-position to the barricade-position, or from the barricade-position to the reserve-position. Alternatively, the motor 70 may be configured to move the stop-device 22 in either direction. A linkage system 73 may be provided to transfer force from the motor 70 to the stop-device 22. Toward that end, the linkage system 73 may include a chain 75 and/or one or more gears 77 (including the sprockets 55) in order to facilitate movement of the stop-device 22 by the motor 70 by transferring a force supplied by the motor 70 to the stop-device 22.

FIGS. 11-14 depict an arrangement of the linkage system 73 that includes a disengaging mechanism 80. The disengaging mechanism 80 allows for movement of the stop-device 22 when the motor 70 is not able to provide the force needed to move the stop-device 22. For example, when electric power cannot be provided to the motor 70, and the motor therefore lacks the ability to move the stop-device 22, the disengaging mechanism 80 may disconnect the motor 70 from the stop-device 22 so that the stop-device 22 can be moved without moving the motor 70. In lieu of moving the stop-device 22 with the motor 70, the stop-device 22 may be moved manually, or by the spring 67, or by a combination thereof. For example, the manual force may be applied to the arm 19, and/or the force of the spring 67 may be applied to the anchor 52.

In FIGS. 11-14, the disengaging mechanism 80 includes an electric clutch 83, which provides a gap when power to the electric clutch 83 is lost. Other disengaging mechanisms 80 may be used, including a solenoid. By providing a gap when power to the motor 70 is lost, the stop-device 22 may be more easily operated manually and/or by spring 67 because the motor 70 need not be turned in order to move the stop-device 22.

In FIGS. 1-7 and 9, the elevation of the stop-device axis 43 is lower than the elevation of the door-handle 85 (the elevations being measured from the floor 28 adjacent to the door 10). These FIGS. 1-7 and 9 also show the elevation of the arm 19 is lower than the elevation of the door handle 85. By placing the stop-device 22, and in particular the arm 19, below the handle 85, a child, a person in a wheelchair, or a person that is crouching or lying on the floor may more easily operate the stop-device 22 to either barricade the door 10, or not. Also, by placing the stop-device 22 near the floor 28, the arm 19 may be operated manually through the application of a force by hand or by foot. Furthermore, placing the stop-device 22 nearer to the floor 28 allows for purposeful and effective operation of the arm 19 by applying a force using major muscle groups, and does not require precise dexterity of the fingers or hands.

To facilitate use, the barricade-device 13 may be configured so that a force of not more than three pounds is required to manually move the stop-device 22 from the reserve-position to the barricade-position. For example, the barricade-device 13 may be configured through the shape of the cam 37 to require not more than three pounds of force applied to the distal-end 88 of the arm 19 in order to move the stop-device 22 to a position in which the spring 67 will then move the stop-device 22 to the barricade-position. By properly shaping the cam 37, more force (but preferably not more than three pounds) may be required to initially move the stop-device 22 through an initial arc of movement than is required to complete movement of the stop-device 22 to the barricade-position. In this manner, an inadvertent application of force to the arm 19 will not likely cause the stop-device 22 to move to the barricade-position, but the amount of force needed to deploy the stop-device 22 is not so great as to prevent most people from being able to deploy the stop-device 22 to the barricade-position.

In this manner, most people (including very young people, very old people, and many disabled people) will be able to operate the barricade-device 13. Furthermore, the barricade-device 13 may be configured so that a force of not more than three pounds is required to manually move the stop-device 22 from the barricade-position to the reserve-position. In this manner, children, a person in a wheelchair, or a person that is crouching or lying on the floor may deactivate the barricade-device 13 when needed, for example if a fire requires evacuation of the sheltered room or space, and thus the door may be un-barricaded quickly and easily so as to allow occupants to traverse the doorway quickly, easily, and without the need to possess precise dexterity of the fingers or hands. As such, the stop-device 22 may be placed in the reserve-position quickly by a wide range of people having differing physical and mental capabilities.

The barricade-device 13 may be configured so that the motor 70 is activated when the distal-end 88 of the arm 19 is moved a predetermined distance (i.e. the stop-device 22 is rotated a desired angle) without the use of the motor 70. For example, activation of the motor 70 may be made when a strike pin 89A reaches a particular location. The motor may be turned off when the strike-pin 89A contacts a latch 89B. In this arrangement, the distal-end 88 of the arm 19 may be moved manually by a predetermined distance, and then the motor 70 will be activated to move the arm 19 into the barricade-position. It may be beneficial to allow movement of that predetermined distance (e.g. that resulting from a 5 degree rotation of the stop-device) by the application of not more than three pounds of force applied to the distal-end 88 of the arm 19.

Figure 14:
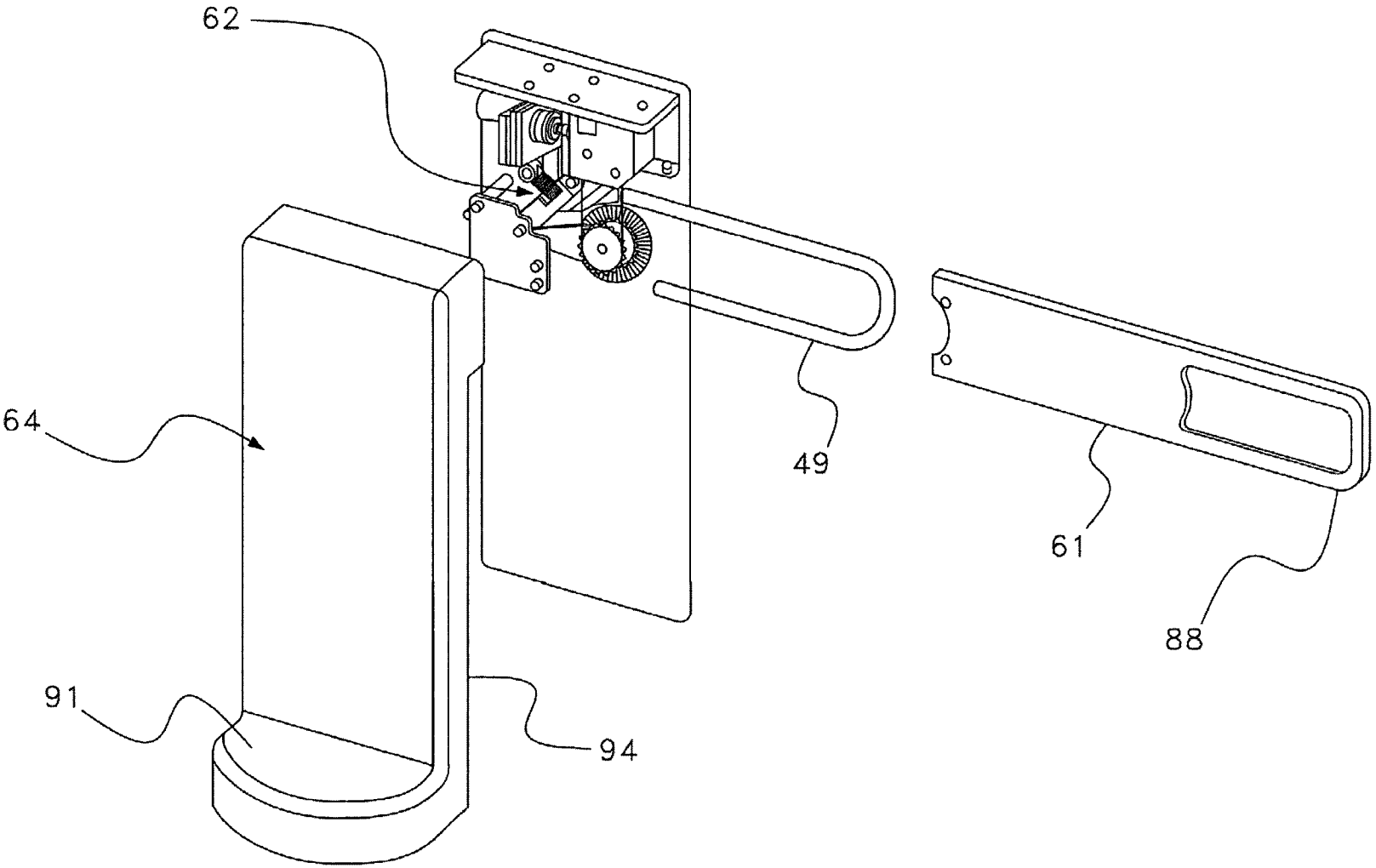
FIG. 14 is an exploded perspective view of a barricade-device.
Figure 15A:
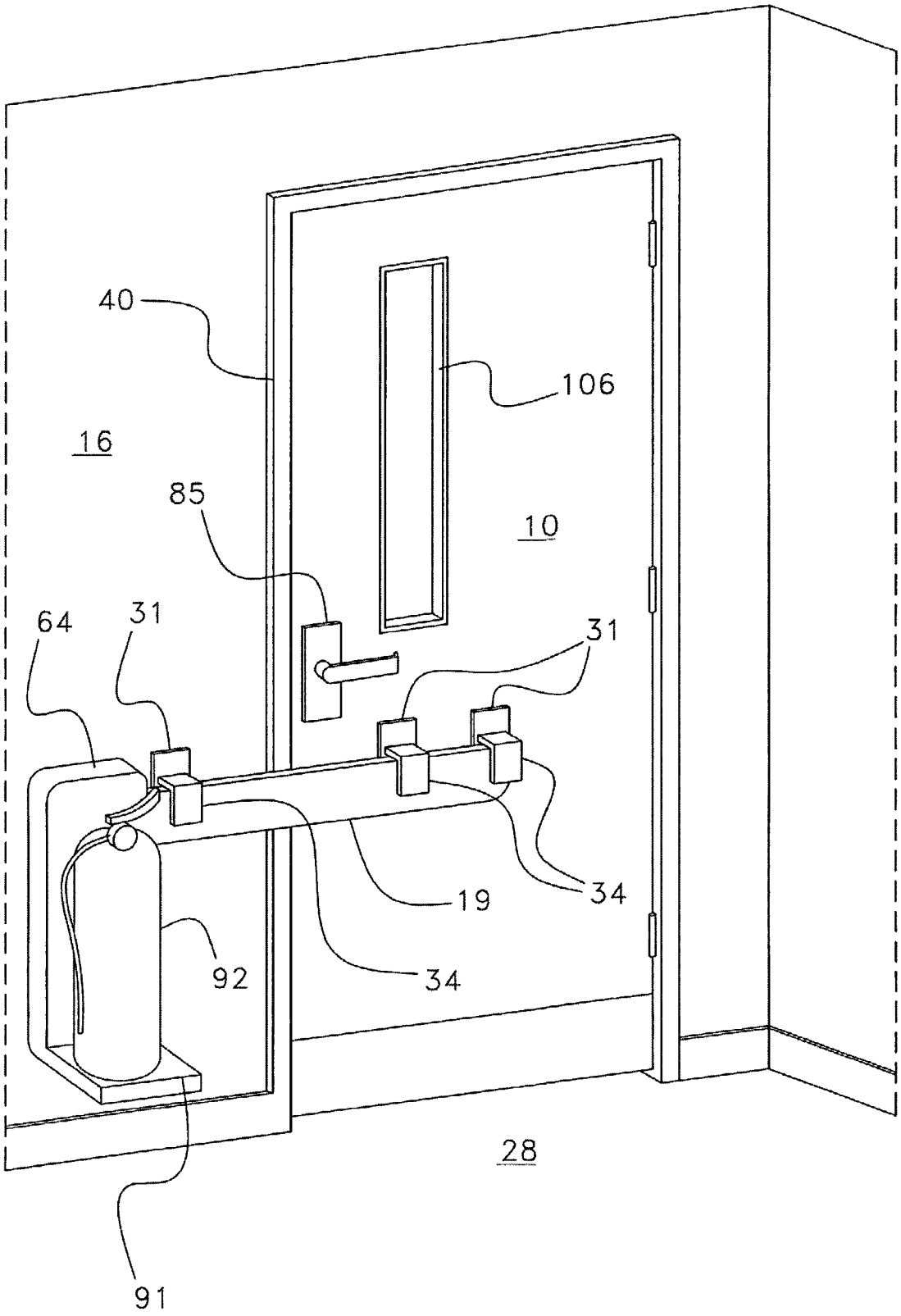
FIG. 15*a* shows a fire extinguisher supported by a ledge.
Figure 15B:
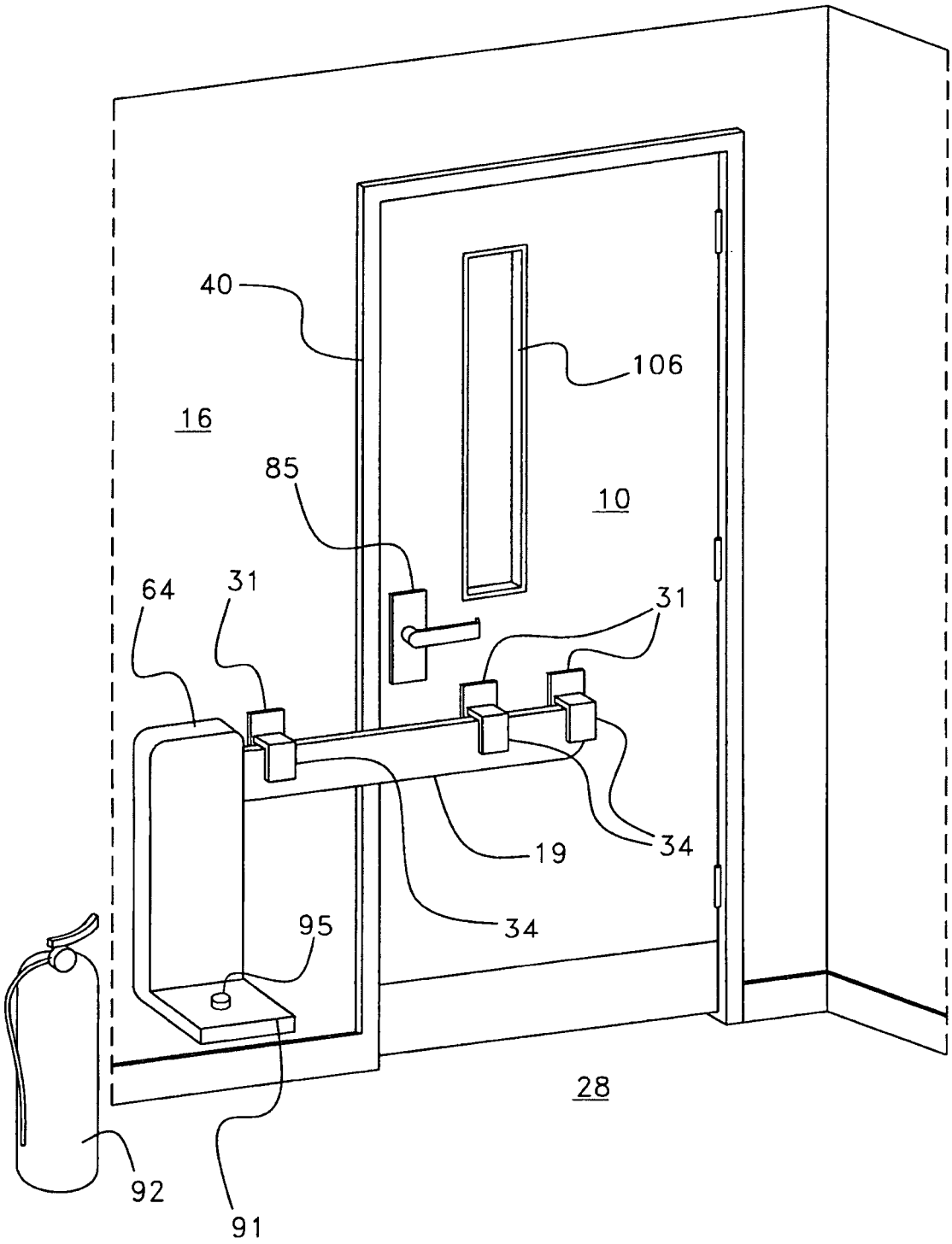
FIG. 15*b* shows the fire extinguisher removed from the ledge.

FIG. 14 shows a cover 64 that may be used with the barricade-device 13. The cover 64 may include a recessed edge 94 so that the arm 19 can move between the reserve-position and the barricade-position. The cover 64 may include a ledge 91 on which may be placed a fire extinguisher 92. FIG. 15*a* shows a fire extinguisher 92 on the ledge 91. When the fire extinguisher 92 is removed (see FIG. 15*b*) from the ledge 91, an alarm may be activated. The alarm may be triggered by a sensor that detects the removal of the fire extinguisher 92. In this manner, a person desiring to use the fire extinguisher 92 need not concern himself with finding a fire alarm to summon the fire department, break glass, or open a cabinet door in order to gain access to the fire extinguisher 92.

In the case of an alarm that is triggered by the removal of the fire extinguisher, a switch may be provided. One such switch may utilize a spring-biased button 95 (see FIG. 15*b*) and a pair of conductive contacts. The weight of the fire extinguisher on the button 95 keeps the button 95 depressed, but when the fire extinguisher is removed, the spring causes the button 95 to move, and this movement of the button 95 is sensed, and the alarm is consequently triggered. For example, the button 95 may be associated with a pair of electrical contacts that touch each other when the fire extinguisher keeps the button 95 depressed. As long as the electrical contacts touch each other, electricity may flow through them. But, when the fire extinguisher is removed, the spring causes the button 95 to move, which separates the electrical contacts thereby causing the electricity to stop flowing, and this cessation of electricity flowing between the contacts is detected by a sensor that triggers the alarm. Alternatively, when the fire extinguisher is in place, the electrical contacts may be separated from each other and thus no electricity flows between the contacts, but movement of the spring-biased button 95 as a result of removing the fire extinguisher results in the electrical contacts coming into contact with each other, which in turn allows electricity to flow between the contacts, and the flowing electricity is then detected by a sensor that triggers the alarm. Other types of switches are possible, such as a magnetic switch that senses the presence of a magnetic material associated with the fire extinguisher, and when the fire extinguisher is removed, a sensor detects that the magnetic material is no longer present, which results in triggering of the alarm.

The barricade-device may include an alarm that is triggered by a predetermined set of circumstances. One such circumstance, the removal of a fire extinguisher, is described above. There are other such circumstances. The alarm or alarm system may include an audible notification and/or a visual notification in order to warn people of a particular type of situation. For example, the alarm may be triggered when (a) the stop-device, and in particular the barricade arm, begins to move toward the barricade-position, and/or (b) when the stop-device, and in particular the barricade arm, reaches the barricade-position, and/or (c) (as noted above) when a fire extinguisher is removed from the door barricade.

When the movable stop-device 22 is in the barricade-position, it may be necessary for an authorized person, such as an emergency responder (e.g. firefighter or police officer) to enter the room. To permit an authorized person to enter the room from a side of the door 10 which does not have the movable stop-device 22, a release/override mechanism 97 may be provided. The release/override mechanism 97 may include a motor and battery having sufficient energy to move the stop-device 22 from the barricade-position to the reserve-position, or may be embodied as a switch that activates the motor 70 to move the stop-device 22. The release/override mechanism 97 causes the stop-device 22 to move to the reserve-position, thereby allowing the authorized person to open the door 10. When the release/override mechanism 97 is operated by an authorized person, the stop-device 22 moves from the barricade-position to the reserve-position, for example via the action of a spring, motor 70, gravity, or some combination of two or more forces applied to the stop-device 22.

Figure 16:
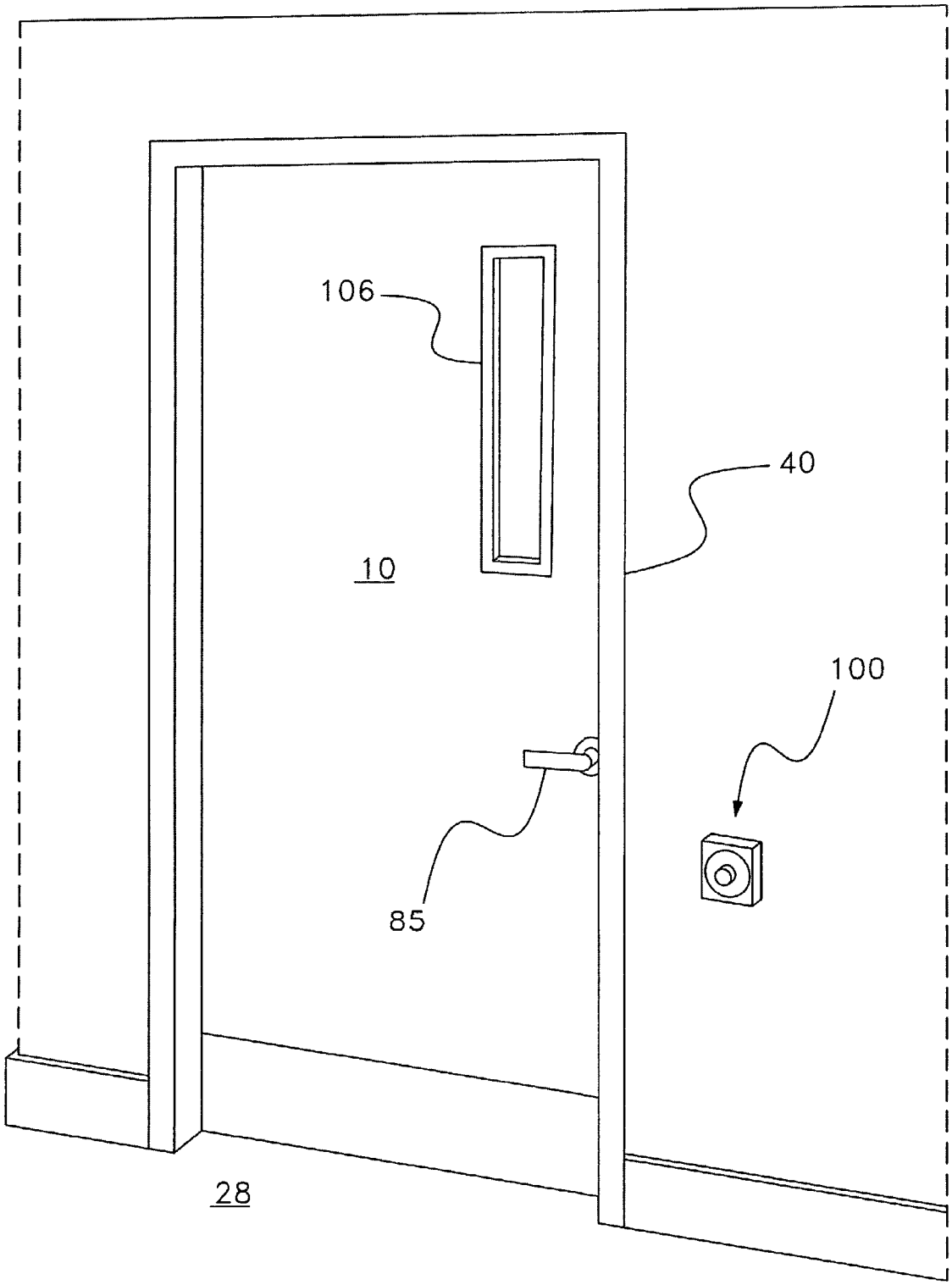
FIG. 16 depicts a side of a classroom door that is opposite to the side having the barricade-device.

The release/override mechanism 97 may include and be activated via an input device 100. FIGS. 16 and 17 show two types of input devices 100. In FIG. 16, the input device 100 accepts a key. An authorized person having the key activates the release/override mechanism 97 by inserting the key into the input device 100 (and optionally, turning the key). In FIG. 17, the input device 100 is a keypad. An authorized person having the proper code activates the release/override mechanism 97 by entering the code on the keypad. By using the key (FIG. 16) or entering a code to the keypad (FIG. 17), an authorized person outside the room can cause the stop-device 22 to move to the reserve-position so that the authorized person can open the door 10 and enter the room. For example, when equipped with a motor 70, activation of the release/override mechanism 97 may cause the motor 70 to move the stop-device 22 to the reserve-position. The input device 100 is not limited to those shown in FIGS. 16 and 17, and may include other input devices 100, such as a card-swipe scanner, biometric scanner (e.g. finger or retina). The input device 100 may be remotely located, such as in a fire command station.

Figure 18:
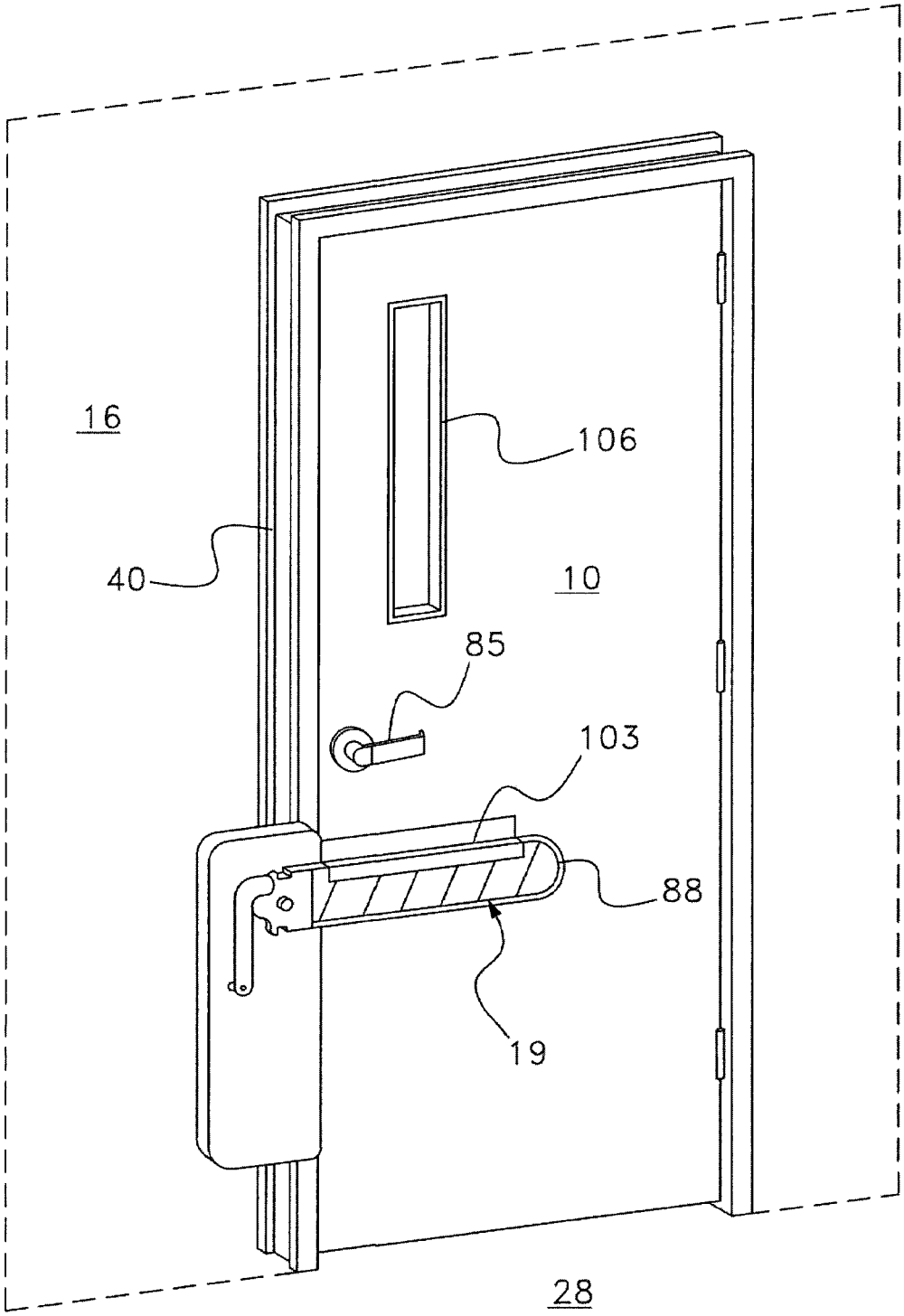
FIG. 18 depicts a barricade-device that includes a shield mounted to the door.

To prevent an intruder from moving the stop-device 22 to the reserve-position, a shield 103 may be provided. FIG. 18 depicts a shield 103 that is designed to prevent an intruder from moving the stop-device 22 by reaching through the window 106.

Figure 20:
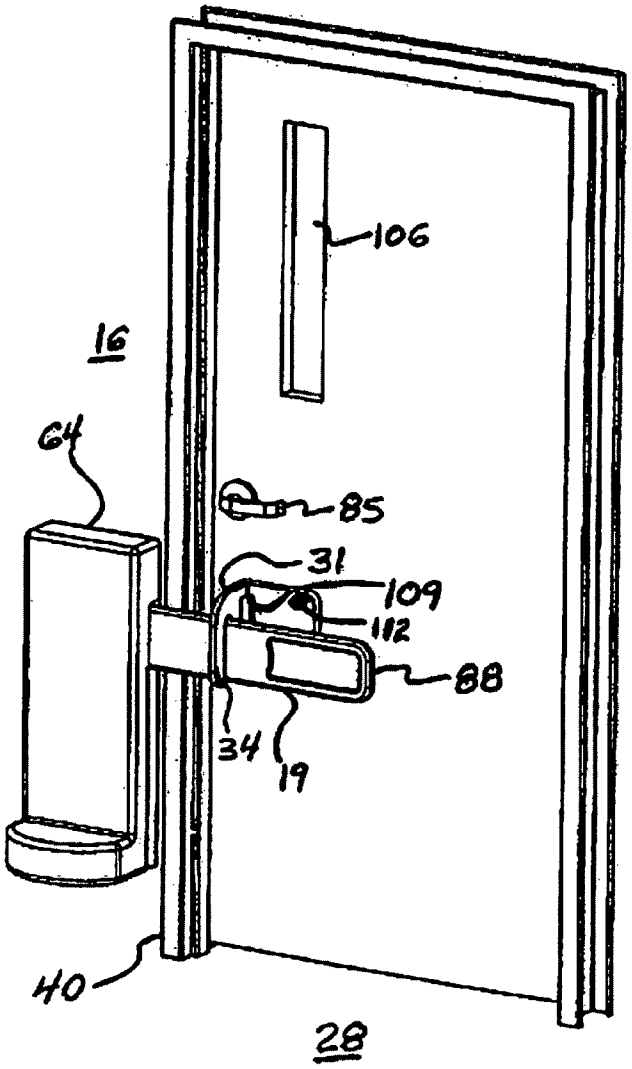
FIGS. 19 and 20 depict a barricade-device that includes a bracket that lays close to the door when the arm is not in the barricade-position, but extends away from the door when needed to overlap the arm of the stop-device.
Figure 19:
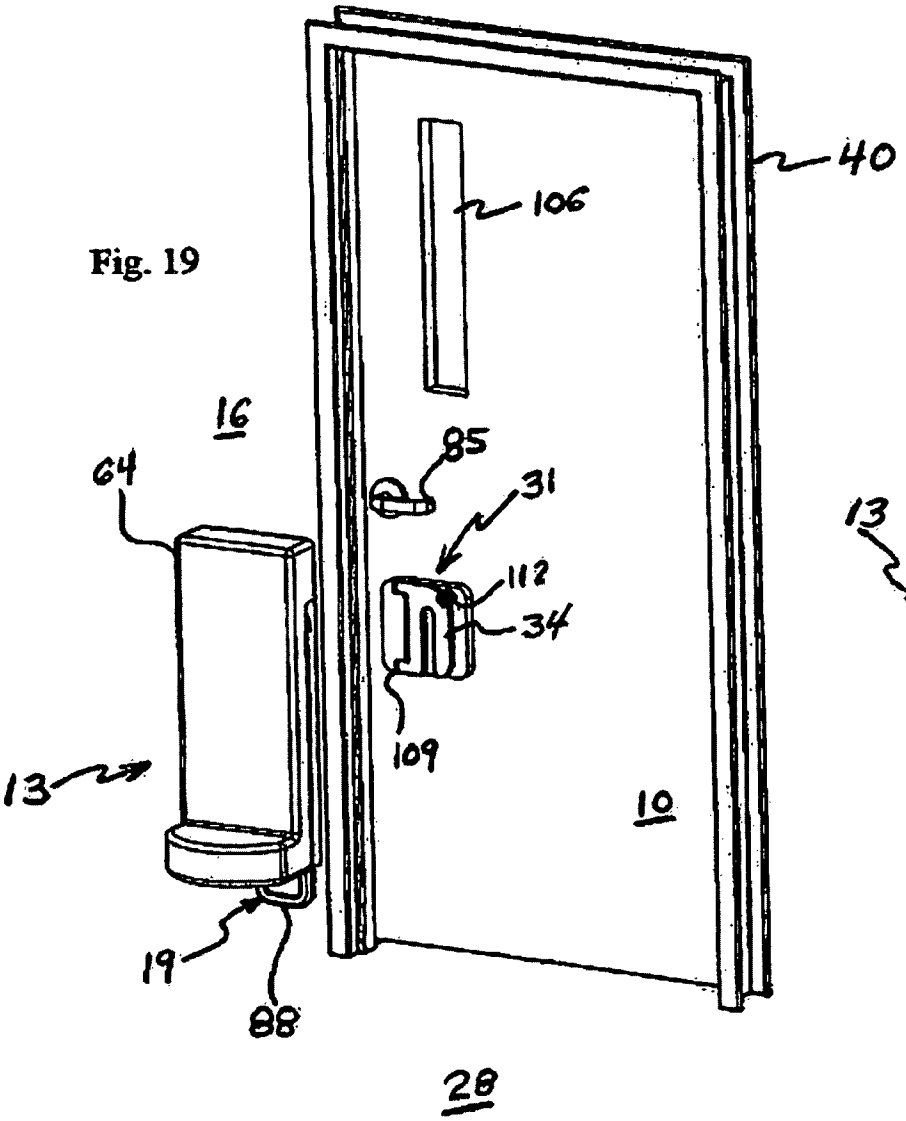

FIGS. 19 and 20 show a barricade-device 13 having a bracket 31 that lays against the door 10 when the arm 19 is not in the barricade-position. When the arm 19 moves toward the barricade-position, the bracket 31 moves to an extended-position in order receive and overlap the arm 19. Such a bracket 31 may be enabled to move to the extended-position by a spring-loaded hinge 109 and a remotely-activated latch 112 that releases the bracket 31 when the arm 19 moves toward the barricade-position. For example, the latch 112 may be released via a remotely-provided electromagnetic frequency. Such an arrangement may be useful where it is desired to have the bracket 31 not extend away from the door 10, except when there is a need to barricade the door 10. It is believed such an arrangement may be particularly useful for out-swinging doors 10 since the bracket 31 may need to extend further from the door 10 than in the situation where the door 10 is in-swinging.

Having described several embodiments of the invention, it will now be recognized that the invention may be embodied as a door barricade-device 13 that has a pivotable stop-device 22. The stop-device 22 may be pivotable about an axis 43 that is nearer to an edge of the door 10 where the door handle 85 and associated latching mechanism is located, than to an edge of the door 10 that is hinged to the door frame 40. The stop-device 22 may be comprised of an arm 19, and the arm 19 may be comprised of a bar 49 and an extension 61, and the extension 61 may be made of a durable, light-weight, plastic material. The stop-device 22 is pivotable from a location adjacent to the door 10, and the pivot location is at an elevation that is lower than a door handle 85 that is mounted on the door 10 and used to unlatch the door 10. The stop-device 22 is pivotable from a reserve-position to a barricade-position. In moving from the reserve-position to the barricade-position, a distal-end 88 of the stop-device 22 moves away from the floor 28 that is adjacent to the door 10. In the reserve-position, the stop-device 22 does not barricade the door 10. But, in the barricade-position, the stop-device 22 barricades the door 10. In the barricade-position, the stop-device 22 need not span the width of the door 10 in order to barricade the door 10.

It will also be recognized that a bracket 31 may be included and positioned to overlap the stop-device 22 when the stop-device 22 is in the barricade-position. But, when the stop-device 22 is in the reserve-position, the bracket 31 does not overlap the stop-device 22. The bracket 31 is oriented to receive the stop-device 22 as the stop-device 22 moves away from the floor 28 that is adjacent to the door 10.

Figure 21:
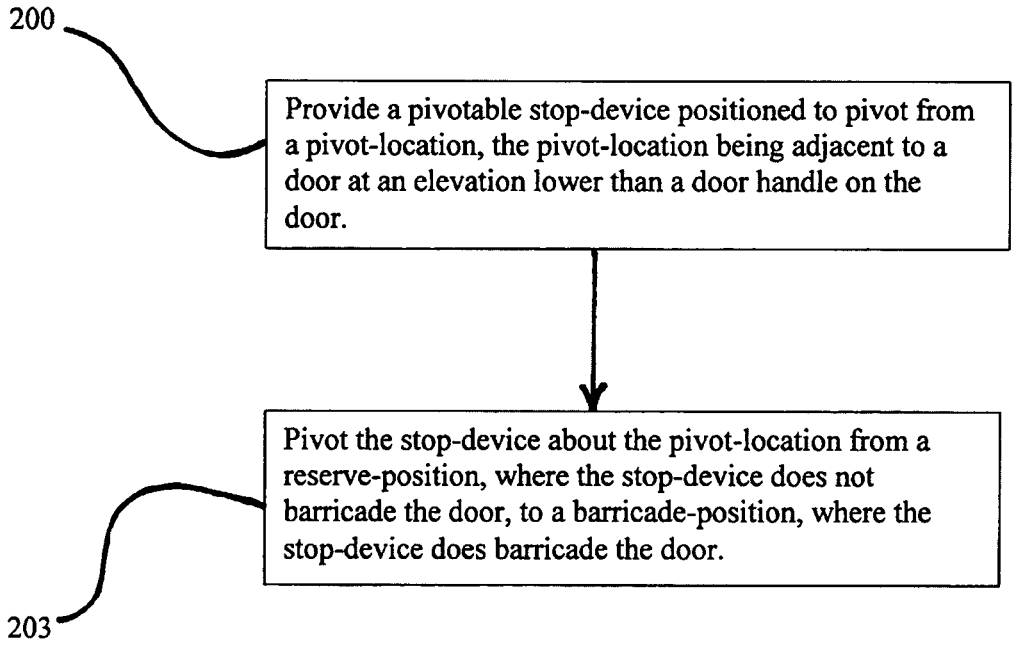
FIG. 21 is a flow chart depicting a method of barricading a door.

The invention may be embodied as a method of barricading a door. FIG. 21 depicts steps of a method for barricading a door. In that method, a pivotable stop-device (such as those described above) is provided 200 and positioned to pivot from a pivot-location. The pivot location is adjacent to the door, but preferably not on the door itself. For example the pivot-location may be coincident with a pivot axis that (if extended) would not traverse the door. Such a pivot axis may traverse (if extended) a wall adjacent to the door, or a frame surrounding the door. The pivot location is placed at an elevation from the floor that is lower than the elevation of a door handle on the door. The method includes pivoting 203 the stop-device about the pivot-location from a reserve-position, where the stop-device does not barricade the door, to a barricade-position, where the stop-device does barricade the door.

In keeping with the description above, a method may include providing a bracket that is positioned to overlap the stop-device when the stop-device is in the barricade-position, but not when the stop-device is in the reserve-position. In such a method, the step of pivoting 203 the stop-device includes the bracket receiving the stop-device as the stop-device moves away from the floor that is adjacent to the door.

A door barricade that is in keeping with the invention may have an activator. Such an activator, when utilized, may result in barricade arm 19 pivoting from a reserve-position to a barricade-position. FIGS. 22-27 depict non-limiting embodiments of the invention having an activator 111 positioned in different locations. For embodiments of the invention having an activator, a user of the barricade-device may execute an activation operation that involves the application of a force of three pounds or less to the activator. An activation operation may involve pressing or pulling the activator or presenting a body part (e.g., a finger) to the activator.

A door barricade may operate by receiving an activation operation, wherein the activation operation involves pressing or pulling the activator or presenting a body part (e.g., a finger) to the activator. Upon receiving the activation operation, the activator may send an electronic signal to a controller via a communication link between the activator and the controller. The controller may have a microprocessor and/or a memory, or may be a simple circuit. In turn, the controller, upon receiving an electronic signal from an activator, may operatively instruct a motor to activate, by way of sending an electronic signal via a communication link between the motor and the controller. The communication links may have one or more wires or be wireless. The motor, when activated, may raise the barricade arm to the barricade-position or lower the barricade arm to the reserve-position, depending on the instructions received from the controller.

Figure 22:
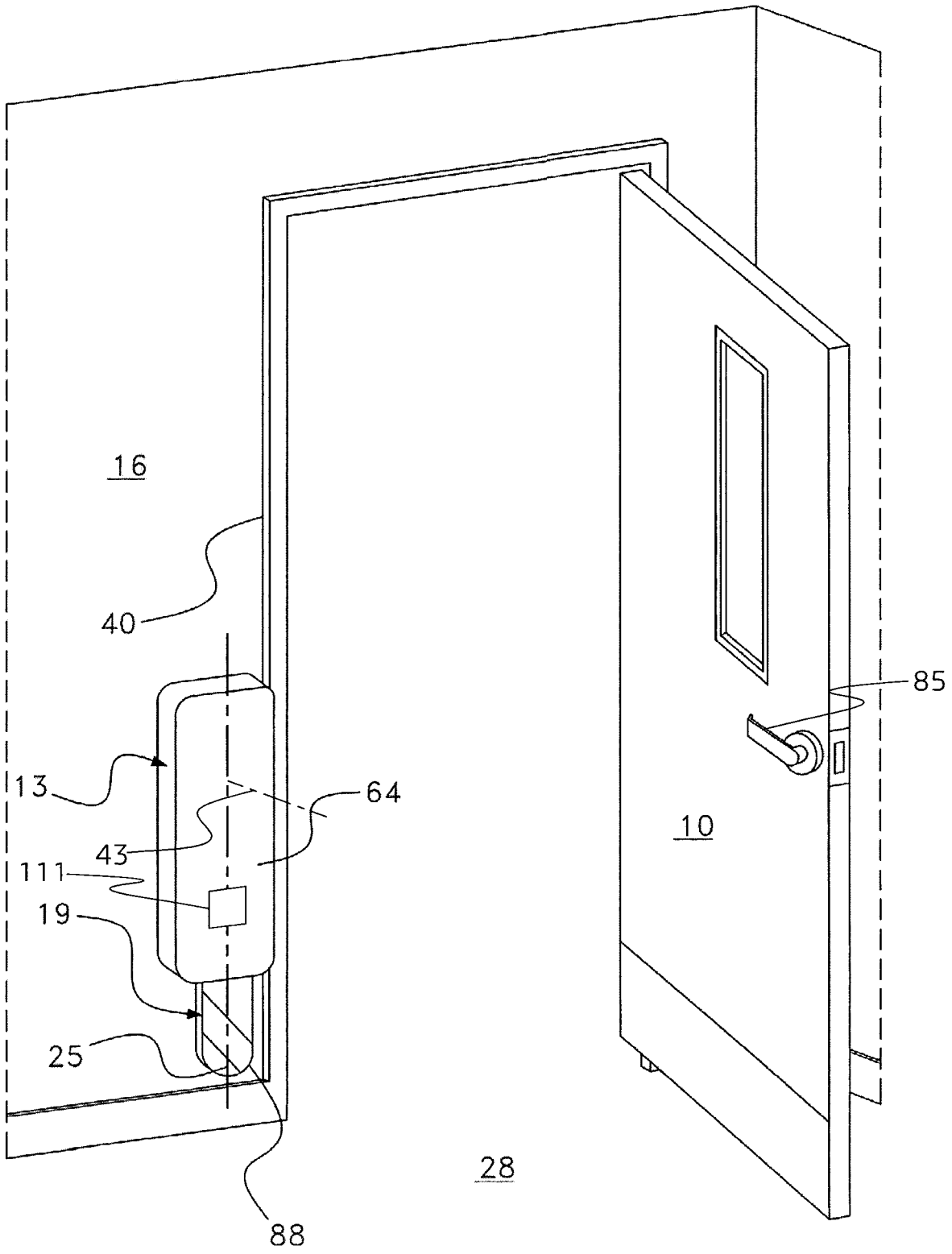
FIG. 22 depicts a barricade-device mounted to a wall adjacent to a door and an activator disposed on the barricade-device.
Figure 23:
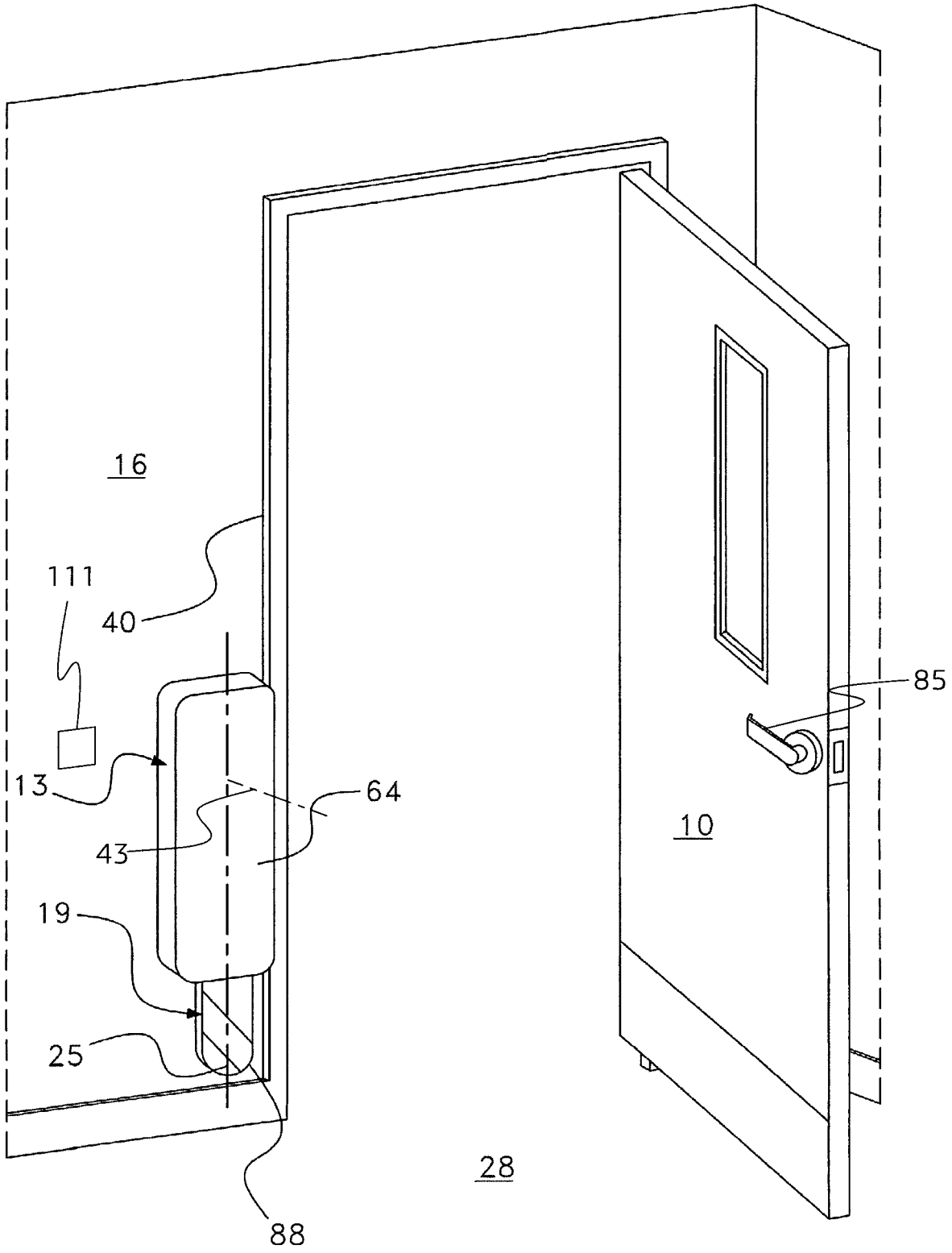
FIG. 23 depicts a barricade-device mounted to a wall adjacent to a door and an activator disposed on that wall.

FIG. 22 depicts an activator 111 disposed on barricade-device 13. In some embodiments of the invention, activator 111 may be disposed near barricade-device 13. For example, FIG. 23 depicts an activator 111 disposed on wall 16 that is adjacent to door 10.

Figure 24:
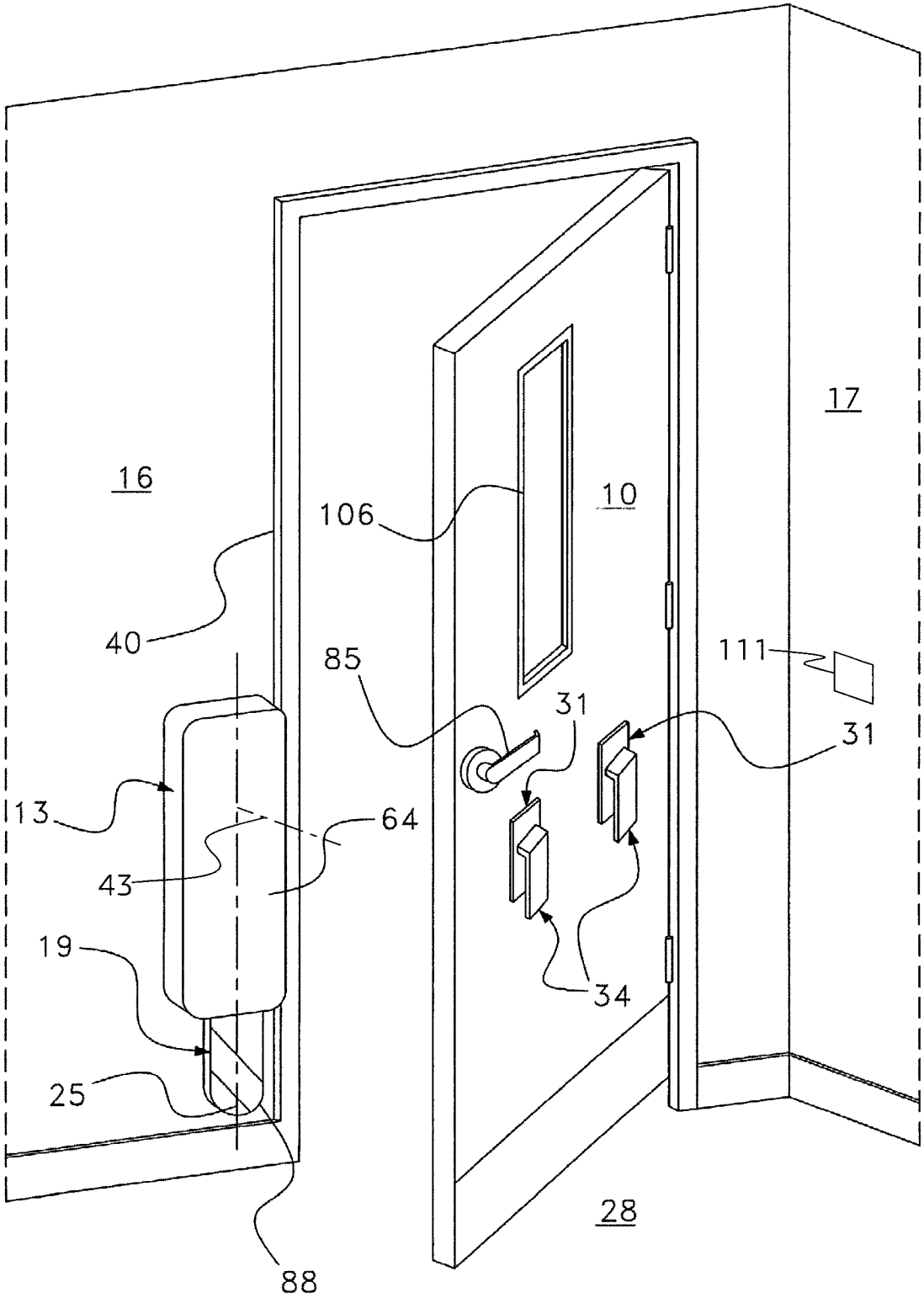
FIG. 24 depicts a barricade-device mounted to a wall adjacent to a door and an activator disposed on a wall near the door.
Figure 25:
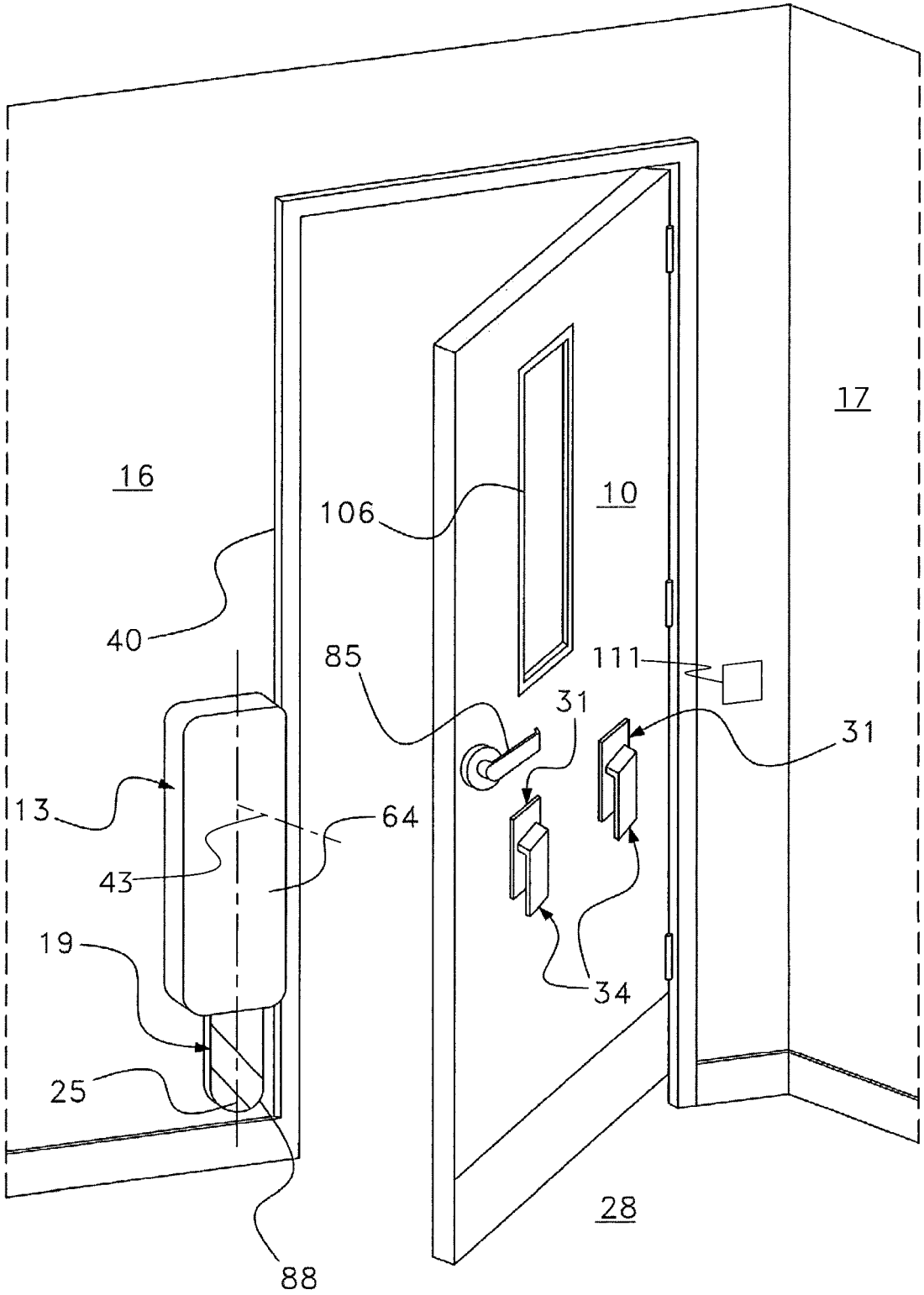
FIG. 25 depicts a barricade-device mounted to a wall adjacent to a door and an activator disposed on a wall adjacent to the door.
Figure 26:
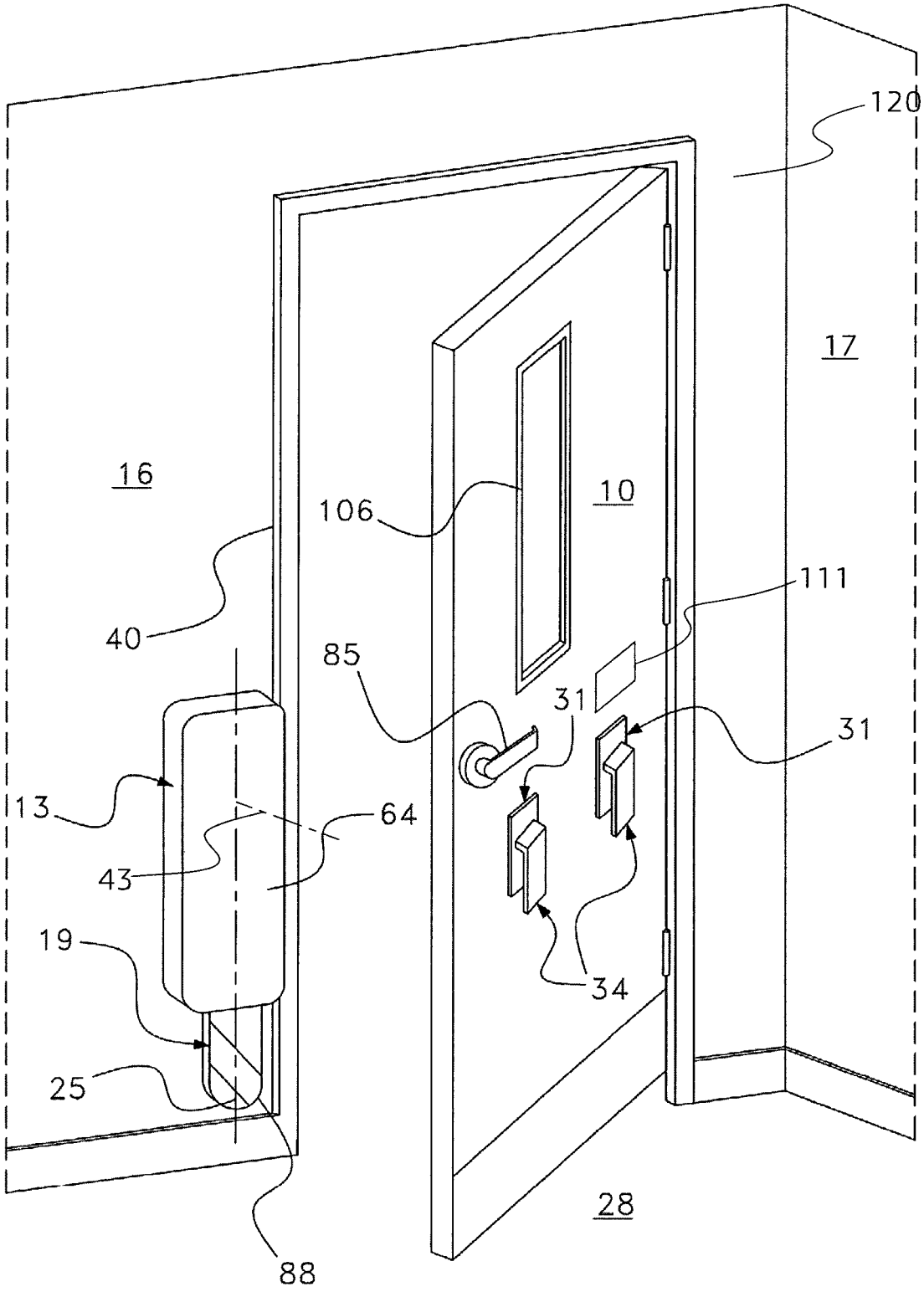
FIG. 26 depicts a barricade-device mounted to a wall adjacent to a door and an activator disposed on the door.

In other embodiments of the invention, an activator 111 may be disposed such that door 10 prevents access to activator 111 when door 10 is fully open. In FIGS. 24-26, activator 111 is located behind door 10 when door 10 is fully opened. FIG. 24 depicts activator 111 disposed on a wall 17 near door 10. FIG. 25 depicts activator 111 disposed on a wall 16 adjacent to door 10. FIG. 26 depicts activator 111 disposed on door 10.

Figure 27:
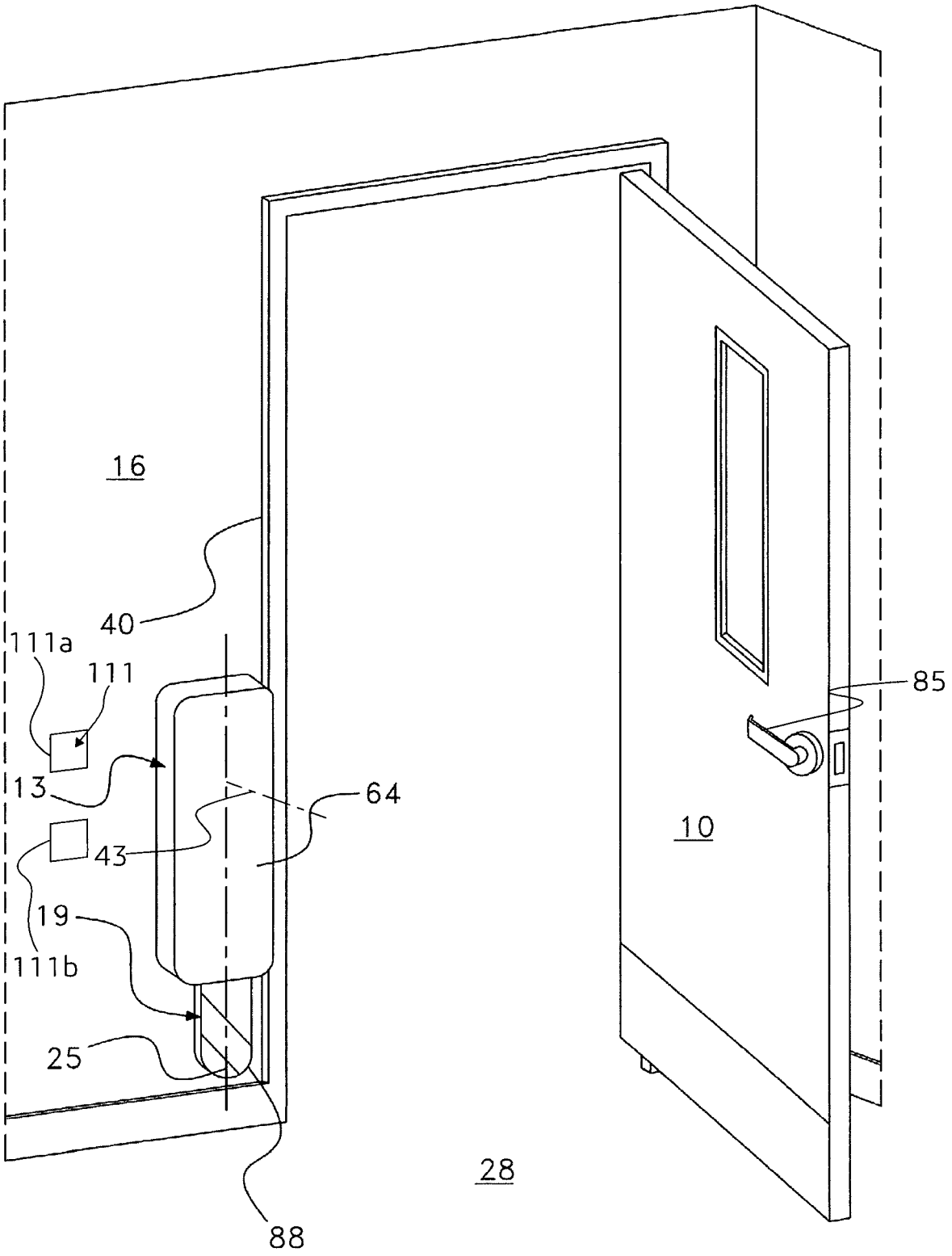
FIG. 27 depicts a barricade-device mounted to a wall adjacent to a door and an activator having two portions disposed on a wall near the door.

In other embodiments of the invention, an activator 111 may have two or more portions. For example, FIG. 27 depicts activator 111 having portions 111*a* and 111*b* disposed on wall 16. The portions 111*a* and 111*b* of activator 111 may be disposed greater than twelve inches apart in order to prevent operation by a single hand, but not greater than thirty-six inches apart in order to permit operation by a single individual. A minimum separation of twelve inches is selected, being the largest known human hand-span, so that an individual is unable to directly utilize the activator using only one of their hands. A maximum separation of thirty-six inches is selected so that most individuals from grade-schoolers to adults are able to utilize the activator using both of their hands. Alternatively, the portions of activator 111 may be disposed twelve inches apart or less to permit operation by a single hand.

Activator 111 may be located at an accessible height above the floor. In such embodiments of the invention, the activator 111 may be placed at or below the height of a door handle 85.

FIGS. 28-38 depict a number of ways in which the activator 111 or activator 111 may be provided. FIG. 28A depicts an activator 111 having a button 113. Button 113 may be substantially rectangular.

Figure 28A:
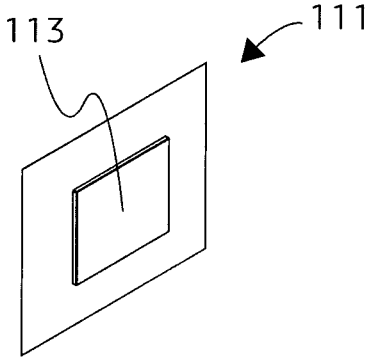
FIG. 28A depicts an activator having a button.
Figure 28B:
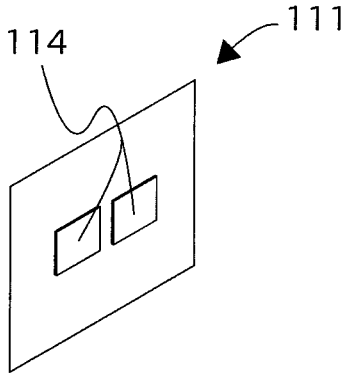
FIG. 28B depicts an activator having two buttons.

FIG. 28B depicts an activator 111 having two buttons 114. It should be noted that activator 111 may have more than two buttons. In some embodiments of the invention, each of the buttons 114 may be substantially rectangular. Arrangement of each of the buttons 114 with respect to the other may vary. The buttons 114 may be arranged in a linear fashion, horizontally, vertically, or other arrangement. One of the buttons 114 may, when utilized, result in the barricade arm 19 moving from the reserve-position to the barricade-position. Another of the buttons 114 may, when utilized, result in the barricade arm 19 moving from the barricade-position to the reserve-position. Alternatively, activator 111 may be configured to require each of the buttons 114 to be pressed in a sequence or simultaneously in order to result in the barricade arm 19 moving. It should be noted that the invention is not limited to the particular arrangements described herein.

The two buttons 114 may be disposed greater than twelve inches apart, but not greater than thirty-six inches apart, in order to prevent operation by a single hand. Alternatively, the buttons 114 may be disposed from each other twelve inches apart or less to permit operation by a single hand.

Figure 29A:
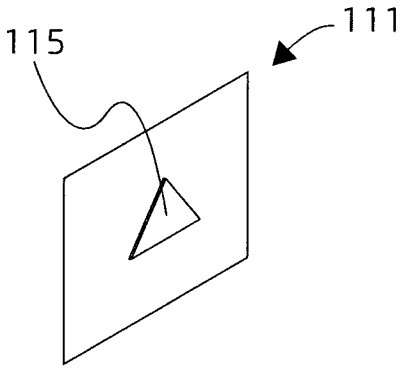
FIG. 29A depicts an activator having a substantially triangular button.
Figure 29B:
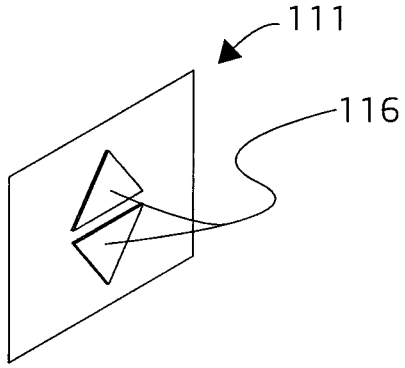
FIG. 29B depicts an activator having two substantially triangular buttons.

FIG. 29A depicts activator 111 that has a button 115 that is substantially triangular. FIG. 29B depicts an activator 111 having two or more buttons 116. In some embodiments of the invention, each of the buttons 116 may be substantially triangular. The arrangement of each of the buttons 116 with respect to each other may vary. In some embodiments of the invention, the buttons 116 may be arranged in a linear fashion. In other embodiments of the invention, the activator 111 may have two buttons, each substantially triangular, but arranged such that their bases are proximate to each other, effectively pointing in opposite directions, as exemplified in FIG. 29*b*. For example, in such an embodiment, one button 116 may point up and the other down. One of buttons 116 may, when utilized, result in the barricade arm 19 moving from the reserve-position to the barricade-position. Another of the buttons 116 may, when utilized, result in the barricade arm 19 moving from the barricade-position to the reserve-position. It should be understood that the invention is not limited the particular arrangements described herein.

Button 113, buttons 114, button 115, or buttons 116 may have corners and/or edges that have a radius, chamfer, or other safety-oriented geometry. Alternatively, the corners of button 113, buttons 114, button 115, or buttons 116 may not have a radius, chamfer, or other safety-oriented geometry.

Figure 30A:
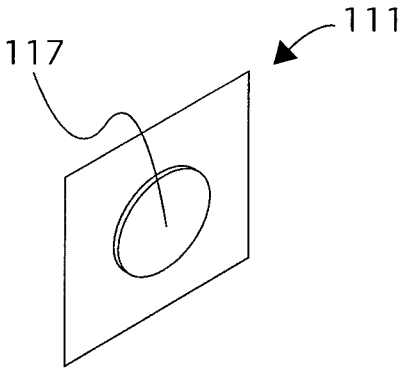
FIG. 30A depicts an activator having a substantially circular button.
Figure 30B:
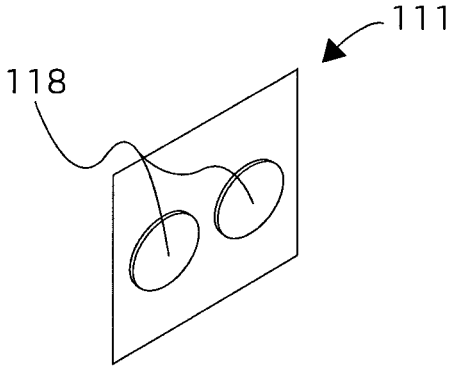
FIG. 30B depicts an activator having two substantially circular buttons.

FIG. 30A depicts activator 111 having a substantially circular button 117. FIG. 30B depicts an activator 111 having two substantially circular buttons 118. Activator 111 may have more than two buttons. In some embodiments of the invention, each of the buttons 118 may be substantially circular. The arrangement of each of the buttons 118 with respect to each other may vary. The buttons 118 may be arranged in a linear fashion, horizontally, vertically, or other arrangement. One of the buttons 118 may, when utilized, result in the barricade arm 19 moving from the reserve-position to the barricade-position. Another of the buttons 118 may, when utilized, result in the barricade arm 19 moving from the barricade-position to the reserve-position. Alternatively, activator 111 may be configured to require each of the buttons 118 to be pressed in a sequence or simultaneously in order to result in the barricade arm 19 moving. However, it is understood that the invention is not limited to the particular arrangements described herein.

Alternatively, activator 111 may be configured to require button 113, 115, or 117, depending on the particular embodiment, to be pressed, pressed for a duration, pressed at least two or more times, or pressed in a sequence, that is, a combination which may include long and short press durations. In some embodiments of the invention, the duration for which button 113, 115, or 117 must be pressed may be greater than one second. In other embodiments of the invention, the sequence in which button 113, 115, or 117 must be pressed may be configurable based on particular install requirements. Install requirements may vary based on the particular preferences of the administrators of the building containing the barricade-device.

Figure 31:
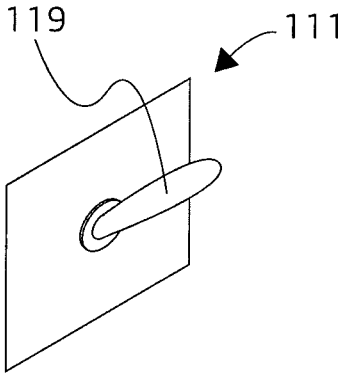
FIG. 31 depicts an activator having a toggle switch.

FIG. 31 depicts activator 111 having a toggle switch 119. Toggle switch 119 may be a momentary or maintained switch, normally-closed or normally-open, and embodiments of the invention may employ a toggle switch 119 that is single-pole, single-throw (SPST), single-pole, double-throw (SPDT), double-pole, double-throw (DPDT), four-pole, single-throw (4PST), or four-pole, double throw (4PDT).

In some embodiments of the invention where toggle switch 119 is a momentary switch, its utilization may result in barricade arm 19 moving to a barricade-position. A second utilization of that momentary switch may then result in the barricade arm 19 moving to a reserve-position. In this manner, use of the toggle switch 119 results in the barricade arm moving from its current position to another position.

In embodiments of the invention where toggle switch 119 is a maintained switch, one position of the toggle switch 119 may result in barricade arm 19 moving to a reserve-position, and another position of the toggle switch 119 may result in barricade arm 19 moving to a barricade-position.

Figure 32:
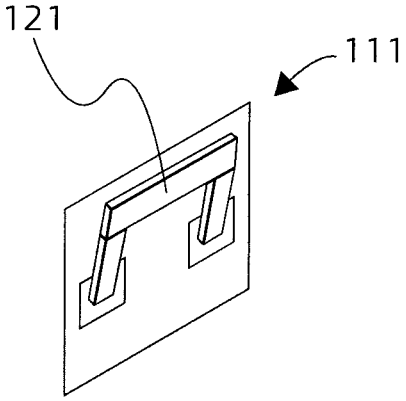
FIG. 32 depicts an activator having a throw lever.

FIG. 32 depicts activator 111 having a throw lever 121. Throw lever 121 may be SPDT or DPDT. In some embodiments of the invention, utilizing throw lever 121 may result in the barricade arm moving to a barricade-position.

Figure 33:
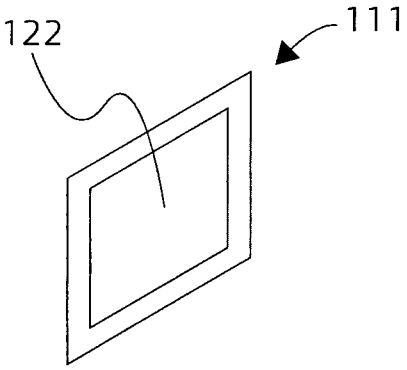
FIG. 33 depicts an activator having an authenticator.

FIG. 33 depicts activator 111 having an authenticator 122. Authenticator 122 may be configured to restrict activation of the barricade arm to authorized individuals. Also, authenticator 122 may be employed to prevent accidental activation of the barricade-device.

Figure 34:
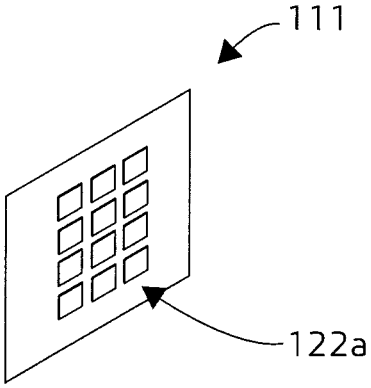
FIG. 34 depicts an authenticator having a keypad.

FIG. 34 depicts an embodiment of activator 111 as an authenticator 122 that includes a keypad 122*a*. Keypad 122*a* may include two or more keys, which, when pressed in sequence result in the activation of the barricade-device. The keys of keypad 122*a* may be labeled or unlabeled. The sequence may correspond to a code or pattern. The keypad may include any number of keys, and may provide a means for setting the sequence in which the keys must be pressed in order to activate the barricade-device. In some embodiments of the invention, one sequence may be entered to move the barricade arm to the barricade-position. The same or another sequence may be entered to move the barricade arm to the reserve-position.

Figure 35:
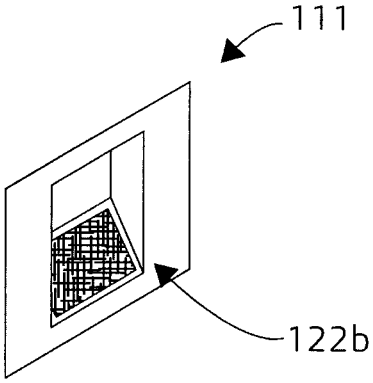
FIG. 35 depicts an authenticator having a fingerprint scanner.

FIG. 35 depicts an embodiment of activator 111 as an authenticator 122 that includes a fingerprint scanner 122*b*. In such embodiments of the invention, the fingerprint scanner 122*b* may serve as an authenticator to limit successful activation of the barricade-device to authorized individuals. An individual may place his or her finger on the fingerprint scanner 122*b*, which may scan the fingerprint. If the scanned fingerprint is that of an authorized individual, the activation operation proceeds, and the barricade-device is activated, with the barricade arm or stop-device raising to the barricade-position. If the scanned fingerprint is not that of an authorized individual, the activation operation does not proceed, and the barricade-device is not activated.

Figure 36:
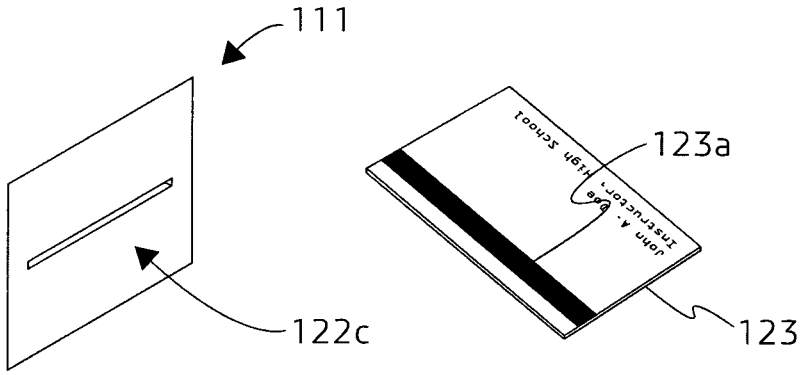
FIG. 36 depicts an authenticator having a card scanner.

FIG. 36 depicts an embodiment of activator 111 as an authenticator 122 that includes a card scanner 122*c*. Card scanner 122*c* may scan and verify a card 123, such as an employee badge or student identification card, to activate the barricade-device. Card scanner 122*c* may scan a card 123, and if the card 123 is verified, the barricade-device is activated. One or more card identities may be stored locally to the barricade-device or remotely to be compared against a card 123 that is presented to the card scanner 122*c*. Card scanner 122*c* may include a means for adding or removing card identities from the system. A successful scan and verification of a card 123 may move the barricade arm to the barricade-position. The same or another card 123 may be scanned and verified to move the barricade arm to the reserve-position. It is understood that card scanner 122*c* may scan a card 123 by radio wave (using protocols such as Wiegand, iCLASS, MIFARE, DESFare, Indala, Prox Card, or near-field communications (NFC)), magnetic strip, optical barcode (including quick-response (QR) codes), mechanical means (including punch card or jagged-edge cards), or Smart Card (contact or contactless). In FIG. 36, for example, card 123 is depicted having a magnetic strip 123*a*. Card scanner 122*c* may have an insertion slot, swipe slot, or be slotless depending on the particular embodiment.

In some embodiments of the invention, a card 123 is stored on the housing of the barricade-device for use with the card scanner 122*c*.

Figure 37:
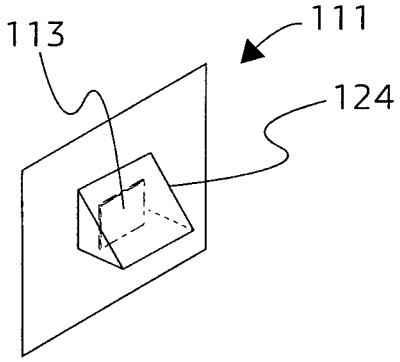
FIG. 37 depicts an activator having a fixed cover.

FIG. 37 depicts activator 111 having a fixed cover 124. In FIG. 37, the activator 111 is depicted as button 113, but it is understood that activator 111 may be another type, including any of the aforementioned types. Fixed cover 124 may be positioned to fully or partially cover the activator 111. In operation, a user may reach into the space partially enclosed by fixed cover 124 to perform the activation operation on the activator 111. In this way unauthorized or accidental activation of activator 111 may be inhibited.

Figure 38:
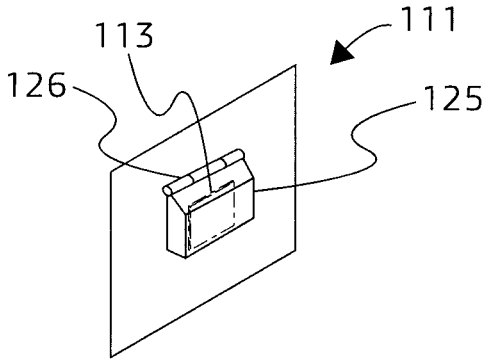
FIG. 38 depicts an activator having a moveable cover.

FIG. 38 depicts activator 111 having a moveable cover 125. In FIG. 38, the activator 111 is depicted as button 113, but it is understood that activator 111 may be another type, including any of the aforementioned types. Moveable cover 125 may be positioned to fully or partially cover activator 111. In operation, a user may move moveable cover 125 and then perform the activation operation on the activator 111. In this way unauthorized or accidental activation of activator 111 may be inhibited.

In an embodiment of the invention, moveable cover 125 may include a hinge 126. In operation, moveable cover may be moved by rotating the cover 125 up, which provides access to the activator 111 thereby allowing a user to perform the activation operation on the activator 111.

In some embodiments of the invention, it may be advantageous for a barricade-device to provide means that prevent unintended, malicious, or other non-emergency use, collectively referred to herein as "non-emergency uses." Various embodiments of the invention may have features that serve to prevent non-emergency uses. For example, in an embodiment of the activator 111, the fingerprint scanner 122*b* may be configured to store information about the scanned fingerprint, and in this way, after the activator is used for non-emergency use, the stored fingerprint(s) information may be retrieved and analyzed to assist in determining the identity of the individual who performed the non-emergency activation operation of scanning a fingerprint on the fingerprint scanner 122*b*.

Activator 111 may include combinations of the types described above. For instance, activator 111 may include an authenticator and a button.

The activation operation may include using the activator as described above. Executing the activation operation may result in a motor moving the barricade arm. In some embodiments of the invention, the activation operation includes pressing a button, toggling a toggle switch, throwing a throw lever, or successfully authenticating an authorized individual or recording biometric information about a person using the activator 111.

Figure 39:
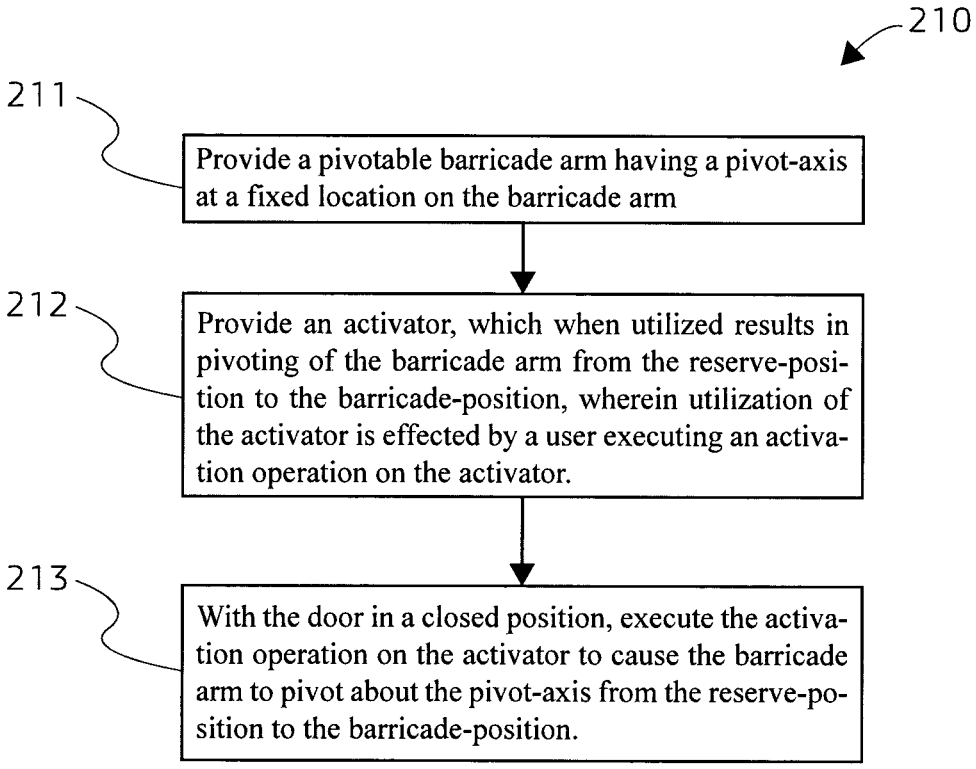
FIG. 39 is a flow chart depicting a method of barricading a door.

Various methods of barricading a door described herein may implement various embodiments of the invention of an activator in addition to permitting activation by an activating force. In such methods, a barricade-device may be activated by providing an activating force as described above or by utilizing an activator according to the various embodiments of the invention described above. FIG. 39 depicts one such method.

The invention may be embodied as a method of barricading a door. FIG. 39 depicts steps of a method 210 for barricading a door. At step 211, a pivotable barricade arm having a pivot-axis at a fixed location on the barricade arm is provided. The fixed location may be nearer to an edge of the door where a latching mechanism of the door is located than to an edge of the door where door hinges are located and at an elevation lower than an elevation of a door handle. At step 212, an activator is provided, which, when utilized results in pivoting of the barricade arm from the reserve-position to the barricade-position. Such utilization of the activator is effected by a user executing an activation operation on the activator. The activation operation does not require the user to apply more than three pounds of force. At step 213, with the door in a closed position, an activation operation is executed on the activator, causing the barricade arm to pivot about the pivot-axis from the reserve position to the barricade-position. At the reserve-position, the barricade arm does not barricade the door, and a free-end of the barricade arm is at a first elevation measured above a floor adjacent to the door. At the barricade-position, the barricade arm barricades the door, and the free-end is at a second elevation measured above the floor adjacent to the door. In providing the barricade arm, elevations are measured from the floor adjacent to the door, and the first elevation is less than the second elevation. In this embodiment of the invention, when the barricade arm is in the barricade-position, it does not span a width of the door and the barricade-position is achieved solely by the barricade arm pivoting from the reserve-position.

Barricade devices and methods of barricading a door have been disclosed herein. Also disclosed are door assemblies, which include a door having a frame, a wall to which the frame is attached, and a barricade-device. Such devices, methods, and assemblies may be used to barricade a door, and thereby prevent an intruder from entering a sheltering space, such as a classroom, storeroom, or hallway. The barricade-device may have a pivotable stop-device that is pivotable from a location adjacent to a door. The pivot-location may be at an elevation that is lower than a door handle on the door. The stop-device may be pivotable from a reserve-position to a stop-position. In the reserve-position, the stop-device does not barricade the door. In the barricade-position, the stop-device barricades the door. Operation of the barricade-device may require the use of one or more major muscle groups of the body, but need not require precise dexterity of the fingers or hands (e.g. such as that required to manipulate small keys, latches, and/or the grasping and turning of assemblies). As such, a wide range of people having differing physical and mental capabilities may use the barricade-device properly and quickly.

Although the present invention has been described with respect to one or more particular embodiments of the invention, it will be understood that other embodiments of the present invention may be made without departing from the spirit and scope of the present invention. Hence, the present invention is deemed limited only by the appended claims and the reasonable interpretation thereof.

What is claimed is:

1. A door barricade, comprising:

a pivotable stop-device including a barricade arm that is:

(i) pivotable about an axis that is:

(a) nearer to an edge of a door where a latching mechanism of the door is located than to an edge of the door where door hinges are located, and (b) at an elevation lower than an elevation of a door handle; and (ii) pivotable about the axis from a reserve-position to a barricade-position, wherein:

(a) in the reserve-position the barricade arm does not barricade the door and a free-end of the barricade arm is at a first elevation, (b) in the barricade-position the barricade arm does barricade the door and the free-end is at a second elevation;

wherein, the elevations are measured from a floor adjacent to the door; and wherein, the first elevation is less than the second elevation;

wherein, when the stop-device is in the barricade-position, the barricade arm does not span the width of the door; and an activator, which when utilized results in the barricade arm pivoting about the axis.

2. The door barricade of claim 1, further comprising a motor capable of providing a force to move the stop-device to the barricade-position, wherein:

the motor is operatively connected to the activator, and the activator is configured to result in operation of the motor when utilized.

3. The door barricade of claim 1, wherein the activator comprises a button.

4. The door barricade of claim 3, wherein the button has a shape that is selected from the group consisting of substantially rectangular, substantially circular, and substantially triangular.

5. The door barricade of claim 3, wherein the barricade-device is configured to move the barricade arm to the barricade-position after the button is pressed.

6. The door barricade of claim 1, wherein the activator comprises:

a first button which, when pressed, raises the barricade arm; and a second button which, when pressed, lowers the barricade arm.

7. The door barricade of claim 6, wherein the first button is substantially triangular pointing in the upwards direction and the second button is substantially triangular pointing in the downwards direction.

8. The door barricade of claim 1, wherein the activator includes a toggle switch or a throw lever.

9. The door barricade of claim 1, wherein the activator includes an authenticator configured to allow only an authorized individual to utilize the activator.

10. The door barricade of claim 9, wherein the authenticator includes a keypad configured to receive an actuation code entered by the authorized individual.

11. The door barricade of claim 9, wherein the authenticator includes a fingerprint scanner capable of scanning a fingerprint of the authorized individual.

12. The door barricade of claim 9, wherein the authenticator includes a card scanner configured to scan a card of the authorized individual.

13. The door barricade of claim 9, wherein the authenticator comprises at least two buttons configured to be pressed substantially simultaneously by the authorized individual.

14. The door barricade of claim 13, wherein the at least two buttons are disposed such that a longest distance between them is twelve inches or less.

15. The door barricade of claim 13, wherein the at least two buttons are disposed such that a longest distance between them is greater than twelve inches and less than or equal to thirty-six inches.

16. The door barricade of claim 1, wherein the activator is disposed on the housing of the barricade-device.

17. The door barricade of claim 1, wherein the activator is disposed at an elevation that is equal to or less than an elevation of the door handle.

18. The door barricade of claim 1, wherein the activator is disposed on a wall adjacent to the door, such that the activator is behind the door when the door is open.

19. The door barricade of claim 1, wherein the activator is disposed on the door.

20. The door barricade of claim 1, wherein the activator includes a fingerprint scanner capable of scanning a fingerprint, converting the fingerprint to fingerprint data, and storing the fingerprint data.

21. A method of barricading a door, comprising:

providing a pivotable barricade arm having a pivot-axis at a fixed location on the barricade arm that is:

(i) nearer to an edge of the door where a latching mechanism of the door is located than to an edge of the door where door hinges are located; and (ii) at an elevation lower than an elevation of a door handle, providing an activator, which when utilized results in pivoting of the barricade arm from the reserve-position to the barricade-position, wherein utilization of the activator is effected by a user executing an activation operation on the activator, the activation operation requiring the user to apply not more than three pounds of force;

with the door in a closed position, executing the activation operation on the activator to cause the barricade arm to pivot about the pivot-axis:

(a) from the reserve-position, where the barricade arm does not barricade the door, and a free-end of the barricade arm is at a first elevation measured above a floor adjacent to the door;

(b) to the barricade-position, where the barricade arm barricades the door, and the free-end is at a second elevation measured above the floor adjacent to the door;

wherein, the elevations are measured from the floor adjacent to the door, and the first elevation is less than the second elevation; and wherein when the barricade arm is in the barricade-position, the barricade arm does not span a width of the door and the barricade-position is achieved solely by the barricade arm pivoting from the reserve-position; and wherein the first elevation is less than the second elevation.

22. The method of claim 21, further comprising:

providing a motor capable of providing a pivot force to pivot the barricade arm without user-assistance to the barricade-position as the means for pivoting, wherein the motor is operatively connected to the activator; and pivoting the barricade arm using the motor.

23. The method of claim 21, wherein the activator comprises a button.

24. The method of claim 23, wherein the button has a shape that is selected from the group consisting of substantially rectangular, substantially circular, and substantially triangular.

25. The method of claim 23, wherein when the barricade arm is in the reserve-position, the activation operation includes pressing the button.

26. The method of claim 21, wherein:

(a) the activator includes a first button, and the activation operation comprises pressing the first button; and (b) the method further comprises providing a second button which, when pressed, lowers the barricade arm.

27. The method of claim 26, wherein the first button is substantially triangular pointing in the upwards direction and the second button is substantially triangular pointing in the downwards direction.

28. The method of claim 21, wherein the activator includes a toggle switch or a throw lever, and the activation operation includes applying the not more than three pounds of force to the toggle switch or throw lever.

29. The method of claim 21, wherein the activator includes an authenticator configured to allow only an authorized individual to complete the activation operation.

30. The method of claim 29, wherein the authenticator includes a keypad, and wherein the activation operation includes entering a code using the keypad.

31. The method of claim 29, wherein the authenticator includes a fingerprint scanner, and wherein the activation operation includes scanning a fingerprint using the fingerprint scanner.

32. The method of claim 29, wherein the authenticator includes a card scanner, and wherein the activation operation includes scanning a card using the card scanner.

33. The method of claim 29, wherein the authenticator includes at least two buttons, and wherein the activation operation includes pressing the at least two buttons substantially simultaneously.

34. The method of claim 33, wherein the at least two buttons are disposed such that a distance between them is twelve inches or less.

35. The method of claim 34, wherein the at least two buttons are disposed such that a distance between them is greater than twelve inches and less than or equal to thirty-six inches.

36. The method of claim 21, wherein the activator is disposed on the housing of the barricade-device.

37. The method of claim 21, wherein the activator is disposed at an elevation that is equal to or less than an elevation of the door handle.

38. The method of claim 21, wherein the activator is disposed on a wall adjacent to the door, such that the activator is behind the door when the door is open.

39. The method of claim 21, wherein the activator is disposed on the door.

40. The method of claim 21, wherein the activator includes a fingerprint scanner, and the wherein the method includes:

scanning a fingerprint, converting the fingerprint to fingerprint data, and storing the fingerprint data.

* * * * *